US009811011B2

(12) United States Patent
Nishi et al.

(10) Patent No.: US 9,811,011 B2
(45) Date of Patent: Nov. 7, 2017

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Masashi Nishi, Susono (JP); Kunihiko Sekido, Suntou-gun (JP); Michiyo Sekiya, Atami (JP); Kei Tagami, Yokohama (JP); Akihito Saitoh, Gotemba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/184,100

(22) Filed: Jun. 16, 2016

(65) Prior Publication Data

US 2016/0378001 A1 Dec. 29, 2016

(30) Foreign Application Priority Data

Jun. 25, 2015 (JP) ..... 2015-128104

(51) Int. Cl.
*G03G 5/14* (2006.01)

(52) U.S. Cl.
CPC ..... *G03G 5/142* (2013.01)

(58) Field of Classification Search
CPC ..... G03G 5/142
USPC ..... 430/64, 60
See application file for complete search history.

(56) References Cited

U.S. PATENT DOCUMENTS 5,430,526 A * 7/1995 Ohkubo ..... G03G 15/0233 399/159
5,455,135 A 10/1995 Maruyama et al.
5,604,061 A 2/1997 Sekido et al.
5,693,443 A 12/1997 Nakamura et al.
6,110,628 A 8/2000 Sekiya et al.
6,228,546 B1 5/2001 Kashizaki et al.
6,372,397 B1 4/2002 Maruyama et al.
6,436,597 B2 8/2002 Maruyama et al.
6,664,014 B1 12/2003 Kikuchi et al.
7,141,341 B2 11/2006 Sekido et al.
7,378,205 B2 5/2008 Sekiya et al.
7,964,328 B2 * 6/2011 Ferrar ..... G03G 5/0571 430/123.4
8,343,699 B2 1/2013 Nagasaka et al.
8,465,889 B2 6/2013 Sekido et al.
8,524,430 B2 9/2013 Takagi et al.
8,546,050 B2 10/2013 Maruyama et al.
8,632,931 B2 1/2014 Sekido et al.
8,795,936 B2 8/2014 Sekido et al.
9,029,054 B2 5/2015 Okuda et al.
9,063,505 B2 6/2015 Sekiya et al.
9,069,267 B2 6/2015 Kaku et al.
9,164,406 B2 10/2015 Nishi et al.
9,207,550 B2 12/2015 Okuda et al.
9,280,072 B2 3/2016 Ogaki et al.
9,335,645 B2 5/2016 Tagami et al.
2014/0004452 A1 * 1/2014 Sekiya ..... G03G 15/00 430/56
2015/0185630 A1 7/2015 Ito et al.
2015/0185632 A1 7/2015 Sekido et al.
2015/0185634 A1 7/2015 Sekiya et al.
2015/0185636 A1 7/2015 Sekiya et al.
2015/0185637 A1 7/2015 Nishi et al.
2015/0185638 A1 7/2015 Nakamura et al.
2016/0116853 A1 4/2016 Sekiya et al.

FOREIGN PATENT DOCUMENTS

JP H05-027469 2/1993
JP H05-134443 5/1993
JP 2001-083726 3/2001
JP 2003-345044 12/2003
JP 2008-065173 3/2008

OTHER PUBLICATIONS

Diamond, A.S., ed., Handbook of Imaging Materials, Marcel Dekker, Inc., NY (1991), pp. 395-396.*
U.S. Appl. No. 15/077,209, Kunihiko Sekido, filed Mar. 22, 2016.
U.S. Appl. No. 15/169,418, Masashi Nishi, filed May 31, 2016.
U.S. Appl. No. 15/184,073, Masashi Nishi, filed Jun. 16, 2016.
U.S. Appl. No. 15/186,749, Kunihiko Sekido, filed Jun. 20, 2016.
"Crosslinking Agent Handbook" edited by Shinzo Yamashita and Tosuke Kaneko, and published by Taiseisha Ltd. (1981), pp. 536-543, 584, 585, and 596-605.
Journal of the American Chemical Society, 130, 14410-14411 (2008).
Chemische Berichte, 124,529-535 (1991).

* cited by examiner

*Primary Examiner* — Janis L Dote
(74) *Attorney, Agent, or Firm* — Fitzpatrick Cella Harper and Scinto

(57) ABSTRACT

Provided are an electrophotographic photosensitive member comprising: a support, an undercoat layer formed on the support, and a photosensitive layer formed on the undercoat layer, on which the undercoat layer contains one of a compound represented by the formula (1) and a polymer of a composition containing the compound represented by the formula (1).

Formula (1)

3 Claims, 3 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, a process cartridge, and an electrophotographic apparatus.

Description of the Related Art

At present, an electrophotographic photosensitive member containing an organic photoconductive material (organic electrophotographic photosensitive member, hereinafter sometimes referred to as "photosensitive member") is in the mainstream of an electrophotographic photosensitive member to be mounted on a process cartridge or an electrophotographic apparatus. The electrophotographic photosensitive member using the organic photoconductive material has advantages, such as a pollution-free property, high productivity, and the ease of material design.

The electrophotographic photosensitive member generally includes a support and a photosensitive layer formed on the support. In addition, the photosensitive layer is generally a laminated photosensitive layer obtained by laminating a charge generating layer and a hole transporting layer in the stated order from a support side. Further, to cope with a problem with an image failure, such as fogging, an undercoat layer is often arranged between the support and the photosensitive layer for suppressing the injection of charge from the support side to a photosensitive layer side to suppress a reduction in charging ability.

In addition, in recent years, a charge generating material having higher sensitivity has been used. However, a rise in sensitivity of the charge generating material involves the following problem. The quantity of charge to be generated increases, and hence the charge is liable to remain in the charge generating layer and a ghost is liable to occur. Specifically, the so-called positive ghost phenomenon in which the density of only a portion irradiated with light at the time of a forward rotation in an output image increases is liable to occur. A technology involving incorporating an electron transporting material into the undercoat layer to smoothen the transfer of an electron from a charge generating layer side to the support side has been known as a technology of suppressing such remaining of the charge in the charge generating layer.

In each of, for example, Japanese Patent Application Laid-Open No. 2001-83726, Japanese Patent Application Laid-Open No. 2003-345044, and Japanese Patent Application Laid-Open No. 2008-65173, as a technology involving incorporating the electron transporting material into the undercoat layer or a layer that can correspond to the undercoat layer, there is a disclosure of a technology involving incorporating the electron transporting material, such as a fluorenone compound derivative, an imide compound derivative, or an anthraquinone derivative, into the undercoat layer. In addition, in each of Japanese Patent Application Laid-Open No. H05-27469 and Japanese Patent Application Laid-Open No. H05-134443, there is a disclosure of a technology involving incorporating a naphthalenetetracarboxylic diimide compound or a benzenetetracarboxylic diimide compound represented by a specific general formula into an intermediate layer (that can correspond to the undercoat layer).

SUMMARY OF THE INVENTION

In recent years, a requirement for the quality of an electrophotographic image has been continuing to grow, and hence an allowable range for the image failure has started to become much narrower.

In addition, the inventors of the present invention have made an investigation, and as a result, have found that the technologies disclosed in the patent literatures are not sufficiently improved in terms of the suppression of the positive ghost in some cases, and hence need to be further improved.

An object of the present invention is to provide an electrophotographic photosensitive member suppressed in fluctuation in potential after continuous image output relative to a potential before the output, and a process cartridge and an electrophotographic apparatus each including the electrophotographic photosensitive member.

The inventors of the present invention have made extensive investigations, and as a result, have found that the incorporation of a compound having a long-chain group or a polymer of a composition containing at least the compound into the undercoat layer of an electrophotographic photosensitive member can provide an electrophotograph suppressed in ghost and free of any image defect.

That is, the present invention relates to an electrophotographic photosensitive member, including: a support; an undercoat layer formed on the support; and a photosensitive layer formed on the undercoat layer, in which the undercoat layer contains at least one of a compound represented by the formula (1) or a polymer of a composition containing the compound represented by the formula (1).

Formula (1)

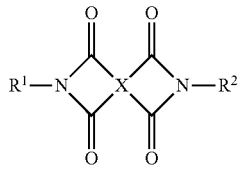

In the formula, X represents one structure selected from the group consisting of structures represented by the formula (X1), the formula (X2), and the formula (X3).

(X1)

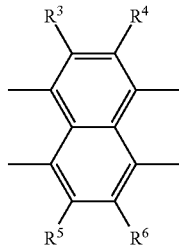

(X2)

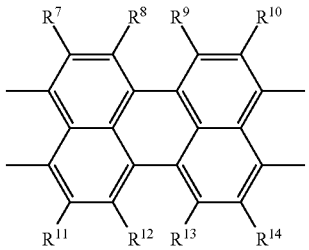

-continued (X3)

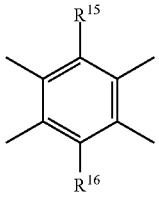

In the formula (1), $R^1$ represents a substituted or unsubstituted alkyl group having 1 or more and 40 or less carbon atoms in a main chain thereof, a group derived by substituting at least one $CH_2$ in a main chain of a substituted or unsubstituted alkyl group having 3 or more and 40 or less carbon atoms in the main chain with an oxygen atom, a group derived by substituting at least one $CH_2$ in a main chain of a substituted or unsubstituted alkyl group having 3 or more and 40 or less carbon atoms in the main chain with a sulfur atom, a group derived by substituting at least one $CH_2$ in a main chain of a substituted or unsubstituted alkyl group having 3 or more and 40 or less carbon atoms in the main chain with $NR^{17}$, a group derived by substituting at least one $CH_2$ in a main chain of a substituted or unsubstituted alkyl group having 3 or more and 40 or less carbon atoms in the main chain with $SiR^{18}R^{19}$, a group derived by substituting at least one carbon-carbon single bond in a main chain of a substituted or unsubstituted alkyl group having 2 or more and 40 or less carbon atoms in the main chain with a carbon-carbon double bond, a substituted or unsubstituted cycloalkyl group having 3 or more and 40 or less carbon atoms in a main chain thereof, or a substituted or unsubstituted aryl group, and $R^{17}$, $R^{18}$, and $R^{19}$ each represent a hydrogen atom, a substituted or unsubstituted alkyl group having 1 or more and 4 or less carbon atoms in a main chain thereof, or a substituted or unsubstituted aryl group.

In the formula (1), $R^2$ represents a substituted or unsubstituted alkyl group having 7 or more and 40 or less carbon atoms in a main chain thereof, a group derived by substituting at least one $CH_2$ in a main chain of a substituted or unsubstituted alkyl group having 7 or more and 40 or less carbon atoms in the main chain with an oxygen atom, a group derived by substituting at least one $CH_2$ in a main chain of a substituted or unsubstituted alkyl group having 7 or more and 40 or less carbon atoms in the main chain with a sulfur atom, a group derived by substituting at least one $CH_2$ in a main chain of a substituted or unsubstituted alkyl group having 7 or more and 40 or less carbon atoms in the main chain with $NR^{20}$, a group derived by substituting at least one $CH_2$ in a main chain of a substituted or unsubstituted alkyl group having 7 or more and 40 or less carbon atoms in the main chain with $SiR^{21}R^{22}$, a group derived by substituting at least one carbon-carbon single bond in a main chain of a substituted or unsubstituted alkyl group having 7 or more and 40 or less carbon atoms in the main chain with a carbon-carbon double bond, or a substituted or unsubstituted cycloalkyl group having 7 or more and 40 or less carbon atoms in a main chain thereof, and $R^{20}$, $R^{21}$, and $R^{22}$ each represent a hydrogen atom, a substituted or unsubstituted alkyl group having 1 or more and 4 or less carbon atoms in a main chain thereof, or a substituted or unsubstituted aryl group.

A substituent of each of the alkyl group, the group derived by substituting at least one $CH_2$ in the main chain of the alkyl group with an oxygen atom, the group derived by substituting at least one $CH_2$ in the main chain of the alkyl group with a sulfur atom, the group derived by substituting at least one $CH_2$ in the main chain of the alkyl group with $NR^{17}$ or $NR^{20}$, the group derived by substituting at least one $CH_2$ in the main chain of the alkyl group with $SiR^{18}R^{19}$ or $SiR^{21}R^{22}$, the group derived by substituting at least one carbon-carbon single bond in the main chain of the alkyl group with a carbon-carbon double bond, and the cycloalkyl group includes an alkyl group having 1 to 6 carbon atoms, a benzyl group, a phenyl group, a hydroxy group, a thiol group, an amino group, or a carboxyl group.

A substituent of the aryl group includes a halogen atom, a cyano group, a nitro group, an alkyl group having 1 to 4 carbon atoms, an acyl group, an alkoxy group, a hydroxy group, a thiol group, an amino group, or a carboxyl group.

In the formula (X1), the formula (X2), and the formula (X3), $R^3$ to $R^{16}$ each independently represent a hydrogen atom, a halogen atom, a cyano group, a nitro group, a substituted or unsubstituted alkyl group having 1 or more and 4 or less carbon atoms in a main chain thereof, or a substituted or unsubstituted aryl group.

The present invention also relates to a process cartridge, including: the electrophotographic photosensitive member; and at least one unit selected from the group consisting of a charging unit, a developing unit, a transferring unit, and a cleaning unit, the process cartridge integrally supporting the electrophotographic photosensitive member and the at least one unit, the process cartridge being removably mounted onto a main body of an electrophotographic apparatus.

The present invention also relates to an electrophotographic apparatus, including: the electrophotographic photosensitive member; a charging unit; an exposing unit; a developing unit; and a transferring unit.

According to the present invention, it is possible to provide the electrophotographic photosensitive member suppressed in positive ghost and the method of producing the electrophotographic photosensitive member. In addition, according to the present invention, it is possible to provide the process cartridge and the electrophotographic apparatus each including the electrophotographic photosensitive member.

Further features of the present invention will become apparent from the following description of exemplary embodiments with reference to the attached drawings.

DESCRIPTION OF THE EMBODIMENTS

Figure 1:
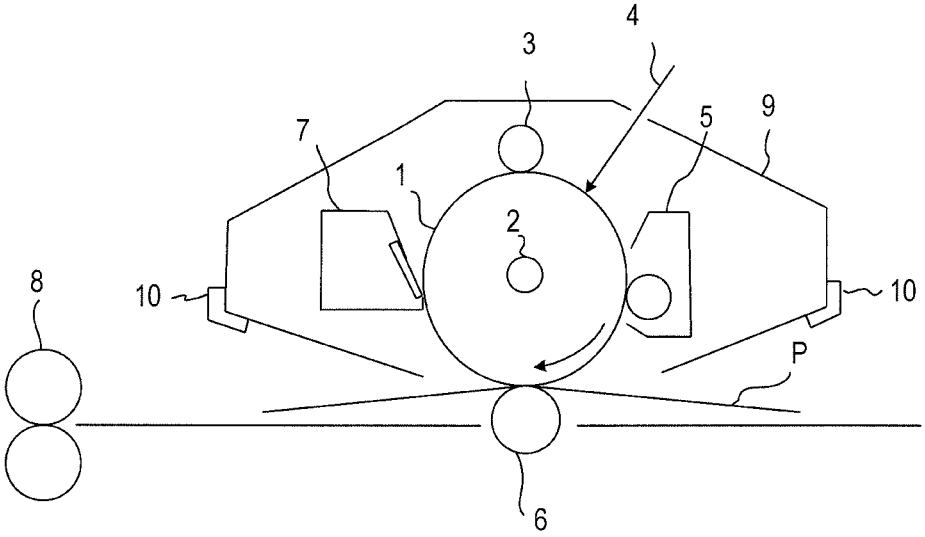
FIG. 1 is a view for illustrating the schematic construction of an electrophotographic apparatus including a process cartridge including an electrophotographic photosensitive member of the present invention.

Preferred embodiments of the present invention will now be described in detail in accordance with the accompanying drawings.

An electrophotographic photosensitive member of the present invention includes a support, an undercoat layer formed on the support, and a photosensitive layer formed on the undercoat layer, the photosensitive layer containing a charge generating material and a hole transporting material. In addition, the electrophotographic photosensitive member has a feature in that the undercoat layer contains a compound represented by the formula (1) or a polymer of a composition containing the compound represented by the formula (1).

Formula (1)

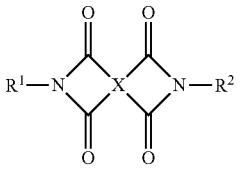

In the formula, X represents one structure selected from the group consisting of structures represented by the formula (X1), the formula (X2), and the formula (X3).

(X1)

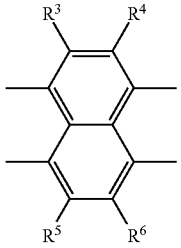

(X2)

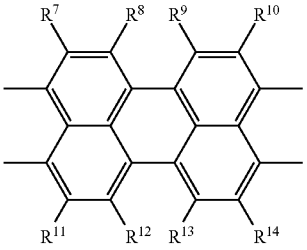

(X3)

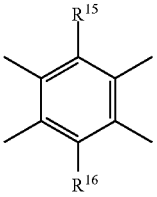

In the formula (1), $R^1$ represents a substituted or unsubstituted alkyl group having 1 or more and 40 or less carbon atoms in a main chain thereof, a group derived by substituting at least one $CH_2$ in a main chain of a substituted or unsubstituted alkyl group having 3 or more and 40 or less carbon atoms in the main chain with an oxygen atom, a group derived by substituting at least one $CH_2$ in a main chain of a substituted or unsubstituted alkyl group having 3 or more and 40 or less carbon atoms in the main chain with a sulfur atom, a group derived by substituting at least one $CH_2$ in a main chain of a substituted or unsubstituted alkyl group having 3 or more and 40 or less carbon atoms in the main chain with $NR^{17}$, a group derived by substituting at least one $CH_2$ in a main chain of a substituted or unsubstituted alkyl group having 3 or more and 40 or less carbon atoms in the main chain with $SiR^{18}R^{19}$, a group derived by substituting at least one carbon-carbon single bond in a main chain of a substituted or unsubstituted alkyl group having 2 or more and 40 or less carbon atoms in the main chain with a carbon-carbon double bond, a substituted or unsubstituted cycloalkyl group having 3 or more and 40 or less carbon atoms in a main chain thereof, or a substituted or unsubstituted aryl group, and $R^{17}$, $R^{18}$, and $R^{19}$ each represent a hydrogen atom, a substituted or unsubstituted alkyl group having 1 or more and 4 or less carbon atoms in a main chain thereof, or a substituted or unsubstituted aryl group.

In the formula (1), $R^2$ represents a substituted or unsubstituted alkyl group having 7 or more and 40 or less carbon atoms in a main chain thereof, a group derived by substituting at least one $CH_2$ in a main chain of a substituted or unsubstituted alkyl group having 7 or more and 40 or less carbon atoms in the main chain with an oxygen atom, a group derived by substituting at least one $CH_2$ in a main chain of a substituted or unsubstituted alkyl group having 7 or more and 40 or less carbon atoms in the main chain with a sulfur atom, a group derived by substituting at least one $CH_2$ in a main chain of a substituted or unsubstituted alkyl group having 7 or more and 40 or less carbon atoms in the main chain with $NR^{20}$, a group derived by substituting at least one $CH_2$ in a main chain of a substituted or unsubstituted alkyl group having 7 or more and 40 or less carbon atoms in the main chain with $SiR^{21}R^{22}$, a group derived by substituting at least one $CH_2$—$CH_2$ in a main chain of a substituted or unsubstituted alkyl group having 7 or more and 40 or less carbon atoms in the main chain with CH═CH, or a substituted or unsubstituted cycloalkyl group having 7 or more and 40 or less carbon atoms in a main chain thereof, and $R^{20}$, $R^{21}$, and $R^{22}$ each represent a hydrogen atom, a substituted or unsubstituted alkyl group having 1 or more and 4 or less carbon atoms in a main chain thereof, or a substituted or unsubstituted aryl group.

A substituent of each of the alkyl group, the group derived by substituting at least one $CH_2$ in the main chain of the alkyl group with an oxygen atom, the group derived by substituting at least one $CH_2$ in the main chain of the alkyl group with a sulfur atom, the group derived by substituting at least one $CH_2$ in the main chain of the alkyl group with $NR^{17}$ or $NR^{20}$, the group derived by substituting at least one $CH_2$ in the main chain of the alkyl group with $SiR^{18}R^{19}$ or $SiR^{21}R^{22}$, the group derived by substituting at least one carbon-carbon single bond in the main chain of the alkyl group with a carbon-carbon double bond, and the cycloalkyl group includes an alkyl group having 1 to 6 carbon atoms, a benzyl group, a phenyl group, a hydroxy group, a thiol group, an amino group, or a carboxyl group.

A substituent of the aryl group includes a halogen atom, a cyano group, a nitro group, an alkyl group having 1 to 4 carbon atoms, an acyl group, an alkoxy group, a hydroxy group, a thiol group, an amino group, or a carboxyl group.

In the formula (X1), the formula (X2), and the formula (X3), $R^3$ to $R^{16}$ each independently represent a hydrogen atom, a halogen atom, a cyano group, a nitro group, a substituted or unsubstituted alkyl group having 1 or more and 4 or less carbon atoms in a main chain thereof, or a substituted or unsubstituted aryl group.

In the compound represented by the formula (1), the alkyl group having 1 or more and 40 or less carbon atoms in the main chain serving as $R^1$ may be a linear or branched alkyl group.

In the compound represented by the formula (1), the group derived by substituting at least one $CH_2$ in the main chain of the substituted or unsubstituted alkyl group having 3 or more and 40 or less carbon atoms in the main chain with an oxygen atom, the group serving as $R^1$, the group derived by substituting at least one $CH_2$ in the main chain of the substituted or unsubstituted alkyl group having 3 or more and 40 or less carbon atoms in the main chain with a sulfur atom, the group serving as $R^1$, the group derived by substituting at least one $CH_2$ in the main chain of the substituted or unsubstituted alkyl group having 3 or more and 40 or less carbon atoms in the main chain with $NR^{17}$, the group serving as $R^1$, and the group derived by substituting at least one $CH_2$ in the main chain of the substituted or unsubstituted alkyl group having 3 or more and 40 or less carbon atoms in the main chain with $SiR^{18}R^{19}$, the group serving as $R^1$, are each a group derived by substituting at least one $CH_2$ of a group having 3 or more and 40 or less carbon atoms out of the alkyl groups each having 1 or more and 40 or less carbon atoms in the main chain, the alkyl groups each serving as $R^1$, with an oxygen atom, a sulfur atom, $NR^{17}$, or $SiR^{18}R^{19}$. However, a group derived by substituting $CH_2$ directly bonded to the nitrogen atom to which $R^1$ is bonded with an oxygen atom, a sulfur atom, $NR^{17}$, or $SiR^{18}R^{19}$ is not preferred because the compound represented by the formula (1) may be unstable.

In the group derived by substituting at least one $CH_2$ in the main chain of the substituted or unsubstituted alkyl group having 3 or more and 40 or less carbon atoms in the main chain with $NR^{17}$, the group serving as $R^1$, and the group derived by substituting at least one $CH_2$ in the main chain of the substituted or unsubstituted alkyl group having 3 or more and 40 or less carbon atoms in the main chain with $SiR^{18}R^{19}$, the group serving as $R^1$, $R^{17}$, $R^{18}$, and $R^{19}$ each represent a hydrogen atom, a substituted or unsubstituted alkyl group, or a substituted or unsubstituted aryl group. Examples of the alkyl group include a methyl group, an ethyl group, a n-propyl group, an isopropyl group, a n-butyl group, a s-butyl group, a t-butyl group, and an isobutyl group, and examples of the aryl group include a phenyl group, a naphthyl group, a fluorenyl group, an anthranyl group, and a phenanthrenyl group.

In the compound represented by the formula (1), the group derived by substituting at least one carbon-carbon single bond in the main chain of the substituted or unsubstituted alkyl group having 2 or more and 40 or less carbon atoms in the main chain with a carbon-carbon double bond, the group serving as $R^1$, is an alkenyl group corresponding to an alkyl group having 2 or more and 40 or less carbon atoms out of the alkyl groups each having 1 or more and 40 or less carbon atoms in the main chain, the groups each serving as $R^1$.

In the compound represented by the formula (1), the substituted or unsubstituted cycloalkyl group having 3 or more and 40 or less carbon atoms in the main chain, the group serving as $R^1$, is such a cycloalkyl group that the number of carbon atoms constituting a cyclic moiety in the functional group is 3 or more and 40 or less, and the group may be a monocyclic cycloalkyl group or a polycyclic cycloalkyl group.

In the compound represented by the formula (1), the alkyl group having 7 or more and 40 or less carbon atoms in the main chain serving as $R^2$ may be a linear or branched alkyl group.

In the compound represented by the formula (1), the group derived by substituting at least one $CH_2$ in the main chain of the substituted or unsubstituted alkyl group having 7 or more and 40 or less carbon atoms in the main chain with an oxygen atom, the group serving as $R^2$, the group derived by substituting at least one $CH_2$ in the main chain of the substituted or unsubstituted alkyl group having 7 or more and 40 or less carbon atoms in the main chain with a sulfur atom, the group serving as $R^2$, the group derived by substituting at least one $CH_2$ in the main chain of the substituted or unsubstituted alkyl group having 7 or more and 40 or less carbon atoms in the main chain with $NR^{20}$, the group serving as $R^2$, and the group derived by substituting at least one $CH_2$ in the main chain of the substituted or unsubstituted alkyl group having 7 or more and 40 or less carbon atoms in the main chain with $SiR^{21}R^{22}$, the group serving as $R^2$, are each a group derived by substituting at least one $CH_2$ of a group having 7 or more and 40 or less carbon atoms out of the alkyl groups each having 1 or more and 40 or less carbon atoms in the main chain, the alkyl groups each serving as $R^2$, with an oxygen atom, a sulfur atom, $NR^{20}$, or $SiR^{21}R^{22}$. However, a group derived by substituting $CH_2$ directly bonded to the nitrogen atom to which $R^2$ is bonded with an oxygen atom, a sulfur atom, $NR^{20}$, or $SiR^{21}R^{22}$ is not preferred because the compound represented by the formula (1) may be unstable.

In the group derived by substituting at least one $CH_2$ in the main chain of the substituted or unsubstituted alkyl group having 7 or more and 40 or less carbon atoms in the main chain with $NR^{20}$, the group serving as $R^2$, and the group derived by substituting at least one $CH_2$ in the main chain of the substituted or unsubstituted alkyl group having 7 or more and 40 or less carbon atoms in the main chain with $SiR^{21}R^{22}$, the group serving as $R^2$, $R^{20}$, $R^{21}$, and $R^{22}$ each represent a hydrogen atom, a substituted or unsubstituted alkyl group, or a substituted or unsubstituted aryl group. Examples of the alkyl group include a methyl group, an ethyl group, a n-propyl group, an isopropyl group, a n-butyl group, a s-butyl group, a t-butyl group, and an isobutyl group, and examples of the aryl group include a phenyl group, a naphthyl group, a fluorenyl group, an anthranyl group, and a phenanthrenyl group.

In the compound represented by the formula (1), the group derived by substituting at least one carbon-carbon single bond in the main chain of the substituted or unsubstituted alkyl group having 7 or more and 40 or less carbon atoms in the main chain with a carbon-carbon double bond, the group serving as $R^2$, is an alkenyl group corresponding to an alkyl group having 7 or more and 40 or less carbon atoms out of the alkyl groups each having 1 or more and 40 or less carbon atoms in the main chain, the groups each serving as $R^1$.

In the compound represented by the formula (1), the substituted or unsubstituted cycloalkyl group having 7 or more and 40 or less carbon atoms in the main chain, the group serving as $R^2$, is such a cycloalkyl group that the number of carbon atoms constituting a cyclic moiety in the functional group is 7 or more and 40 or less, and the group may be a monocyclic cycloalkyl group or a polycyclic cycloalkyl group.

In the compound represented by the formula (1), the substituent of each of the alkyl group, the group derived by substituting at least one $CH_2$ in the main chain of the alkyl group with an oxygen atom, the group derived by substituting at least one $CH_2$ in the main chain of the alkyl group with a sulfur atom, the group derived by substituting at least one $CH_2$ in the main chain of the alkyl group with $NR^{17}$, the group derived by substituting at least one $CH_2$ in the main chain of the alkyl group with $SiR^{18}R^{19}$, the group derived by substituting at least one carbon-carbon single bond in the main chain of the alkyl group with a carbon-carbon double bond, and the cycloalkyl group, the groups each serving as $R^1$ or $R^2$, may be an alkyl group having 1 to 6 carbon atoms, a benzyl group, a phenyl group, a hydroxy group, a thiol group, an amino group, or a carboxyl group. Examples of the alkyl group having 1 to 6 carbon atoms serving as the substituent include, but not limited to, a methyl group, an ethyl group, a n-propyl group, an isopropyl group, a n-butyl group, a s-butyl group, a t-butyl group, an isobutyl group, a n-pentyl group, a pentan-2-yl group, a pentan-3-yl group, a 2-methylbutyl group, a 2-methylbutan-2-yl group, a 3-methylbutan-2-yl group, a 3-methylbutyl group, a 2,2-dimethyl-n-propyl group, a n-hexyl group, a hexan-2-yl group, a hexan-3-yl group, a 2-methylpentyl group, a 2-methylpentan-2-yl group, a 2-methylpentan-3-yl group, a 4-methylpentan-2-yl group, a 3-methylpentyl group, a 4-methylpentyl group, a 3-methylpentan-2-yl group, a 3-methylpentan-3-yl group, a 2,2-dimethylbutyl group, a 3,3-dimethylbutan-2-yl group, a 3,3-dimethylbutyl group, a 2,3-dimethylbutyl group, a 2,3-dimethylbutan-2-yl group, and a 3,3-dimethylbutan-2-yl group. The hydroxy group, the thiol group, the amino group, and the carboxyl group each have a function as a polymerizable functional group.

In the compound represented by the formula (1), examples of the aryl group serving as $R^1$ or $R^2$ include, but not limited to, a phenyl group, a naphthyl group, a fluorenyl group, an anthranyl group, and a phenanthrenyl group. The aryl group may have a halogen atom, a cyano group, a nitro group, an alkyl group having 1 to 4 carbon atoms, an acyl group, an alkoxy group, a hydroxy group, a thiol group, an amino group, or a carboxyl group as a substituent. Examples of the halogen atom serving as the substituent can include fluorine, chlorine, bromine, and iodine. In addition, the alkyl group having 1 to 4 carbon atoms serving as the substituent is a methyl group, an ethyl group, a n-propyl group, an isopropyl group, a n-butyl group, a s-butyl group, a t-butyl group, or an isobutyl group. Further, the acyl group and the alkoxy group each serving as the substituent are each a group having bonded thereto the alkyl group having 1 to 4 carbon atoms through a carbonyl group or an oxygen atom. The hydroxy group, the thiol group, the amino group, and the carboxyl group each have a function as a polymerizable functional group.

The main chain in each of $R^1$ and $R^2$ means a chain portion defined as follows except for the case of a cycloalkyl group: when a carbon atom bonded to the nitrogen atom of the compound represented by the formula (1) to which $R^1$ or $R^2$ is bonded is defined as a starting point, and the lengths of straight lines starting from the carbon atom are measured, the longest straight line is defined as the main chain.

In the structures represented by the formula (X1), (X2), and (X3), examples of the alkyl group serving as $R^3$ to $R^{16}$ include a methyl group, an ethyl group, a n-propyl group, an isopropyl group, a n-butyl group, a s-butyl group, a t-butyl group, and an isobutyl group. The alkyl group may have a halogen atom, a cyano group, a nitro group, or an aryl group as a substituent. Examples of the halogen atom serving as the substituent can include fluorine, chlorine, bromine, and iodine. Examples of the aryl group serving as the substituent can include a phenyl group, a naphthyl group, a fluorenyl group, an anthranyl group, and a phenanthrenyl group.

In the structures represented by the formula (X1), (X2), and (X3), examples of the aryl group serving as $R^3$ to $R^{16}$ include a phenyl group, a naphthyl group, a fluorenyl group, an anthranyl group, and a phenanthrenyl group. The aryl group may have a halogen atom, a cyano group, a nitro group, or an alkyl group as a substituent. Examples of the halogen atom serving as the substituent can include fluorine, chlorine, bromine, and iodine. Examples of the alkyl group serving as the substituent can include a methyl group, an ethyl group, a n-propyl group, an isopropyl group, a n-butyl group, a s-butyl group, a t-butyl group, and an isobutyl group.

Here, a difference in structure between each of the specific naphthalenetetracarboxylic diimide compound described in Japanese Patent Application Laid-Open No. H05-27469 and the specific benzenetetracarboxylic diimide compound described in Japanese Patent Application Laid-Open No. H05-134443, and the compound represented by the formula (1) in the present invention is described.

The specific naphthalenetetracarboxylic diimide compound described in Japanese Patent Application Laid-Open No. H05-27469 and the specific benzenetetracarboxylic diimide compound described in Japanese Patent Application Laid-Open No. H05-134443 each differ from the compound represented by the formula (1) in the present invention in that two N substituents are the same alkyl group having a carboxylic acid ester group at a terminal thereof.

Further, owing to the difference in structure, the molecules of a compound in which two N substituents are identical to each other, such as the specific naphthalenetetracarboxylic diimide compound described in Japanese Patent Application Laid-Open No. H05-27469 or the specific benzenetetracarboxylic diimide compound described in Japanese Patent Application Laid-Open No. H05-134443, i.e., the so-called symmetric compound are more liable to aggregate than the molecules of an asymmetric compound are. Further, the N substituents are each an alkyl group having a carboxylic acid ester at a terminal thereof. Accordingly, the ester groups interact with each other and hence the molecules are even more liable to aggregate. Accordingly, the molecules of each of the specific compounds described in Japanese Patent Application Laid-Open No. H05-27469 and Japanese Patent Application Laid-Open No. H05-134443 are liable to aggregate at the time of the drying of the compound under heating, and hence the effects of the compound represented by the formula (1) in the present invention are not obtained.

[Support]

The support is preferably a support having electroconductivity (electroconductive support). Examples thereof include supports each made of a metal, such as aluminum, nickel, copper, gold, or iron, or an alloy thereof. The examples further include supports each obtained by forming, on an insulating support, such as polyester, polycarbonate, polyimide, or glass, a thin film of a metal, such as aluminum, silver, or gold, or a thin film of an electroconductive material, such as indium oxide or tin oxide.

The surface of the support may be subjected to an electrochemical treatment, such as anodization, or a treatment, such as wet honing, blasting, or cutting, in order that its electrical characteristics may be improved or interference fringes that are liable to occur at the time of irradiation with coherent light, such as a semiconductor laser, may be suppressed.

[Undercoat Layer]

The undercoat layer is arranged between the photosensitive layer and the support. Hereinafter, "the compound represented by the formula (1)" can be replaced by "the polymer of a composition containing the compound represented by the formula (1)".

The undercoat layer can be formed by: forming a coating film of a coating liquid for an undercoat layer containing the composition containing the compound represented by the formula (1); and drying the coating film. The coating liquid may be produced by dissolving the compound represented by the formula (1) alone in a solvent, or the coating liquid may be produced by further combining the compound with any other material, such as a resin. Examples of the resin include, but not limited to, a polyester resin, a polycarbonate resin, a polyvinyl butyral resin, an acrylic resin, a silicone resin, an epoxy resin, a melamine resin, a urethane resin, a phenol resin, and an alkyd resin. In addition, one kind of the resins may be used alone, or two or more kinds thereof may be used as a mixture. When the compound represented by the formula (1) is used in combination with the other material, such as the resin, the ratio (formula (1)/resin) of the compound to the resin preferably falls within the range of 1/10 or more, but the compound represented by the formula (1) may be used at a ratio of less than 1/10 to the extent that charge retention can be suppressed. Examples of the solvent include an ether-based solvent, an alcohol-based solvent, a ketone-based solvent, and an aromatic hydrocarbon solvent, but the coating liquid may be produced by dispersing the compound in water.

The thickness of the undercoat layer is preferably 0.2 μm or more and 3.0 μm or less, more preferably 0.4 μm or more and 1.5 μm or less.

In addition, the coating film may be formed by directly melting the compound represented by the formula (1) under heating.

Further, at the time of the drying of the coating film of the coating liquid for an undercoat layer containing the compound represented by the formula (1), a cured film may be formed by polymerizing the compound represented by the formula (1) having a polymerizable functional group. At that time, thermal or optical energy may be applied to accelerate the polymerization reaction (curing reaction), or a catalyst may be added. Further, the coating liquid for an undercoat layer containing the compound represented by the formula (1) may contain a crosslinking agent, and a resin having a polymerizable functional group or a resin free of any functional group, or a combination thereof may be further used. At the time of the formation of the cured film through the polymerization as described above, all the molecules of the compound represented by the formula (1) of the present invention having a feature of having a long-chain group are not necessarily required to form crosslinked structures with the crosslinking agent or the resin.

A compound that polymerizes (cures) or crosslinks with the compound represented by the formula (1) can be used as the crosslinking agent. Specifically, for example, a compound described in "Crosslinking Agent Handbook" edited by Shinzo Yamashita and Tosuke Kaneko, and published by Taiseisha Ltd. (1981) can be used.

A mass ratio between the crosslinking agent and the compound represented by the formula (1), which may adopt any value, is preferably from 100:50 to 100:250 out of the possible values.

When the mass ratio falls within the range, the following situation is conceivable: the aggregation of the molecules of the crosslinking agent is suppressed, and as a result, the number of trap sites in the undercoat layer reduces and a ghost suppressing effect is further improved. The content of the resin having a polymerizable functional group in the undercoat layer is preferably from 3 mass % to 60 mass %, more preferably from 5 mass % to 20 mass % with respect to the total mass of the composition of the undercoat layer.

Examples of the crosslinking agent include an isocyanate compound and an amine compound described below, but the present invention is not limited thereto. In addition, two or more kinds of the crosslinking agents may be used in combination.

The isocyanate compound is preferably an isocyanate compound having a plurality of isocyanate groups or blocked isocyanate groups. Examples of the isocyanate compound include triisocyanatobenzene, triisocyanatomethylbenzene, triphenylmethane triisocyanate, lysine triisocyanate, and an isocyanurate modified product, biuret modified product, allophanate modified product, and trimethylolpropane or pentaerythritol adduct modified product of a diisocyanate, such as tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl 2,6-diisocyanatohexanoate, or norbornane diisocyanate. Of those, an isocyanurate modified product and an adduct modified product are more preferred.

An isocyanate compound that can be purchased (crosslinking agent) is exemplified by: isocyanate-based crosslinking agents, such as DURANATE MFK-60B or SBA-70B manufactured by Asahi Kasei Chemicals Corporation, and DESMODUR BL3175 or BL3475 manufactured by Sumika Bayer Urethane Co., Ltd; amino-based crosslinking agents, such as U-VAN 20SE60 or 220 manufactured by Mitsui Chemicals, Inc., and SUPER BECKAMINE L-125-60 or G-821-60 manufactured by DIC Corporation; and acrylic crosslinking agents, such as FANCRYL FA-129AS or FA-731A manufactured by Hitachi Chemical Company, Ltd.

The amine compound is preferably, for example, an amine compound having a plurality of N-methylol groups or alkyl-etherified N-methylol groups. Examples thereof include methylolated melamine, methylolated guanamine, a methylolated urea derivative, a methylolated ethylene urea derivative, methylolated glycoluril, and these compounds whose methylol sites are alkyl-etherified, and derivatives thereof.

An amine compound that can be purchased (crosslinking agent) is exemplified by SUPER MELAMI No. 90 (manufactured by NOF Corporation), SUPER BECKAMINE (trademark) TD-139-60, L-105-60, L127-60, L110-60, J-820-60, or G-821-60 (manufactured by DIC Corporation), U-VAN 2020 (Mitsui Chemicals, Inc.), Sumitex Resin M-3 (Sumitomo Chemical Company), NIKALAC MW-30, MW-390, or MX-750LM (manufactured by Nippon Carbide Industries Co., Inc.), SUPER BECKAMINE (trademark) L-148-55, 13-535, L-145-60, or TD-126 (manufactured by DIC Corporation), NIKALAC BL-60 or BX-4000 (manufactured by Nippon Carbide Industries Co., Inc.), or NIKALAC MX-280, NIKALAC MX-270, or NIKALAC MX-290 (manufactured by Nippon Carbide Industries Co., Inc.).

Preferred examples of the polymerizable functional group of the resin having the polymerizable functional group capable of polymerization (curing) include a hydroxy group, a thiol group, an amino group, a carboxyl group, and a methoxy group. Examples of the resin having the polymerizable functional group include a polyether polyol, a polyester polyol, a polyacrylic polyol, a polyvinyl alcohol, a polyvinyl acetal, a polyamide, a carboxyl group-containing resin, a polyamine, and a polythiol. The present invention is not limited thereto. In addition, two or more kinds of the resins may be used in combination.

A resin having a polymerizable functional group that can be purchased is exemplified by: a polyether polyol-based resin, such as AQD-457 or AQD-473 manufactured by Nippon Polyurethane Industry Co., Ltd. or SANNIX GP-400 or GP-700 manufactured by Sanyo Chemical Industries, Ltd.; a polyester polyol-based resin, such as PHTHALKYD W2343 manufactured by Hitachi Chemical Co., Ltd., WATERSOL S-118 or CD-520 manufactured by DIC Corporation, or HARIDIP WH-1188 manufactured by Harima Chemicals; a polyacrylic polyol-based resin, such as BURNOCK WE-300 or WE-304 manufactured by DIC Corporation; a polyvinyl alcohol-based resin, such as KURARAY POVAL PVA-203 manufactured by Kuraray Co., Ltd; a polyvinyl acetal-based resin, such as BX-1, BM-1, KS-1, or KS-5 manufactured by Sekisui Chemical Co., Ltd.; a polyamide-based resin, such as TORESIN FS-350 manufactured by Nagase ChemteX Corporation; a carboxyl group-containing resin, such as AQUALIC manufactured by Nippon Shokubai Co., Ltd. or FINELEX SG2000 manufactured by Namariichi Co., Ltd.; a polyamine resin, such as LUCKAMIDE manufactured by DIC Corporation; or a polythiol resin, such as QE-340M manufactured by Toray Industries, Inc.

The weight-average molecular weight of the resin having a polymerizable functional group falls within the range of preferably from 5,000 to 400,000, more preferably from 5,000 to 300,000.

A ratio between the compound represented by the formula (1) and any other composition in the composition is preferably from 100:50 to 100:250 from the viewpoint of the suppression of the positive ghost.

The undercoat layer may contain, for example, any other resin (resin free of any polymerizable functional group), organic particles, inorganic particles, or a leveling agent in addition to the polymer for improving its film formability and electrical characteristics. However, the content of such material in the undercoat layer is preferably 50 mass % or less, more preferably 20 mass % or less with respect to the total mass of the undercoat layer.

The electrophotographic photosensitive member including the undercoat layer of the present invention is excellent in suppression of a reduction in chargeability and suppression of a ghost because the undercoat layer suppresses the injection of charge from the support and the retention of an electron in a charge generating layer.

The compound represented by the formula (1) to be used in the undercoat layer in the present invention has a feature of having a substituted or unsubstituted alkyl group having 7 or more and 40 or less carbon atoms in the main chain, a group derived by substituting at least one $CH_2$ in the main chain of a substituted or unsubstituted alkyl group having 7 or more and 40 or less carbon atoms in the main chain with an oxygen atom, a group derived by substituting at least one $CH_2$ in the main chain of a substituted or unsubstituted alkyl group having 7 or more and 40 or less carbon atoms in the main chain with a sulfur atom, a group derived by substituting at least one $CH_2$ in the main chain of a substituted or unsubstituted alkyl group having 7 or more and 40 or less carbon atoms in the main chain with $NR^{20}$, a group derived by substituting at least one $CH_2$ in the main chain of a substituted or unsubstituted alkyl group having 7 or more and 40 or less carbon atoms in the main chain with $SiR^{21}R^{22}$, a group derived by substituting at least one carbon-carbon single bond in the main chain of a substituted or unsubstituted alkyl group having 7 or more and 40 or less carbon atoms in the main chain with a carbon-carbon double bond, or a substituted or unsubstituted cycloalkyl group having 7 or more and 40 or less carbon atoms in the main chain.

The undercoat layer in the present invention can be formed by: applying a solution obtained by dissolving or dispersing the compound represented by the formula (1) in a solvent; or melting the very compound represented by the formula (1) and applying the molten compound. The introduction of a long-chain group into the compound represented by the formula (1) can impart, to the compound represented by the formula (1), such proper solubility that the undercoat layer does not dissolve at the time of the application of the charge generating layer serving as an upper layer. As a result, the contamination of the charge generating layer is suppressed and hence satisfactory electrophotographic characteristics free of any ghost are obtained. In addition, appropriate flexibility can be imparted to the film of the compound by the long-chain group, and hence its adhesive property with the charge generating layer serving as an upper layer is improved. When the film is formed only of the compound represented by the formula (1), the concentration of an aryl diimide moiety serving as an electron conveying moiety in the film can be increased, and hence the stagnation of electron conveyance can be effectively resolved. From the above-mentioned viewpoints of the present invention, in order that satisfactory electrophotographic characteristics reduced in ghost may be obtained, a long-chain group whose main chain has 7 or more and 40 or less atoms is used, and in terms of, for example, the ease of synthesis, a long-chain group whose main chain has 7 or more and 20 or less atoms is suitably used. In formula (1), the main chain of each of $R^1$ and $R^2$ may have 20 or less carbon atoms, preferably 7 to 20 carbon atoms. However, even a long-chain group whose main chain has more than 40 atoms can be used to the extent that the film formability and electron conveying property of the compound are not impaired.

In addition, the undercoat layer in the present invention can be formed by dissolving or dispersing the compound represented by the formula (1) and a resin in a solvent, and applying the resultant. Also in the mixed system with the resin, a certain combination of the compound represented by the formula (1) and the resin enables more effective film formation. The compound represented by the formula (1) to be used in the present invention can be applied in accordance with the characteristics of the resin to be used because the characteristics of the compound, such as polarity, each vary depending on the long-chain group to be introduced.

Further, in the undercoat layer in the present invention, when the compound represented by the formula (1) having a polymerizable functional group, such as a hydroxy group, is used, a film having a crosslinked structure, the film being formed as follows, can be used: a crosslinking agent or a resin having a functional group that can polymerize with the functional group of the compound represented by the formula (1) is dissolved or dispersed in a solvent, and the resultant is applied and subjected to a curing process. At that time, by virtue of such features of the compound represented by the formula (1) as described above, even in a state in which the state of the curing is weak (state in which a functional group for crosslinking remains), the compound represented by the formula (1) does not dissolve at the time of the application of the charge generating layer, and hence stable film formation can be achieved. Accordingly, the stable film formation can lead to the alleviation of a film formation condition in a production process for the undercoat layer. Also in a completely cured state (all the molecules of the compound represented by the formula (1) form bonds with the crosslinking agent or the resin), flexibility can be imparted to the film by at least one long-chain group of the compound represented by the formula (1), and hence satisfactory electrophotographic characteristics can be obtained. The compound represented by the formula (1) having a polymerizable functional group, such as a hydroxy group, can also of course be used in a single system or a mixed system with a material, such as a resin, which does not have such crosslinked structure as described above.

The skeleton of the compound represented by the formula (1) can be synthesized by using a known synthesis method described in, for example, Journal of the American Chemical Society, 130, 14410-14411 (2008), or Chemische Berichte, 124, 529-535 (1991). The compound can be synthesized by, for example, a reaction between pyromellitic dianhydride or perylenetetracarboxylic dianhydride available from Tokyo Chemical Industry Co., Ltd., Sigma-Aldrich Japan K.K., or Johnson Matthey Japan Incorporated and a monoamine derivative.

In addition, in order that a polymerizable functional group (a hydroxy group, a carboxyl group, a thiol group, or an amino group) may be introduced into the skeletal body of the compound represented by the formula (1), for example, a method involving directly introducing the curable functional group into the synthesized skeleton is available. In addition to the foregoing, a method involving introducing a structure having the curable functional group or a functional group that can serve as a precursor of the curable functional group (e.g., a method involving introducing a functional group-containing aryl group into a halide of an imide derivative through the use of a cross-coupling reaction involving using a palladium catalyst and a base, a method involving introducing a functional group-containing alkyl group through the use of a cross-coupling reaction involving using a $FeCl_3$ catalyst and a base, or a method involving subjecting the halide to lithiation and then causing an epoxy compound or $CO_2$ to act on the resultant to introduce a hydroxyalkyl group or a carboxyl group) is available. In addition to the foregoing, a method involving using a pyromellitic anhydride derivative, a perylenetetracarboxylic dianhydride derivative, or a monoamine derivative having the curable functional group or a functional group that can serve as a precursor of the curable functional group as a raw material at the time of the synthesis of the imide derivative is available.

Specific examples of the compound represented by the formula (1) are shown in Table 1 below, but the present invention is not limited to these compounds.

TABLE 1

| Exemplified Compound | $R^1$ | X | $R^2$ |
|---|---|---|---|
| A101 | 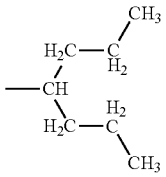 | 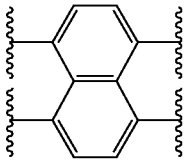 | 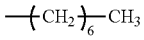 |
| A102 | 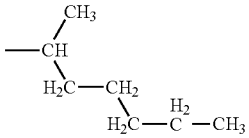 | 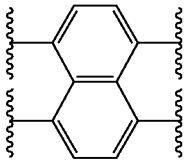 | 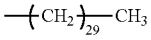 |
| A103 | 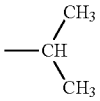 | 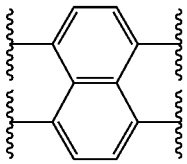 | 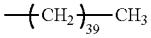 |
| A104 | 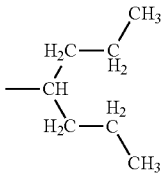 | 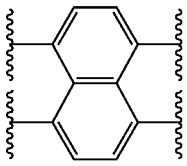 | 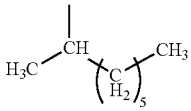 |
| A105 | 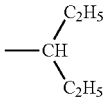 | 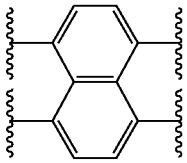 | 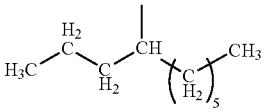 |
| A106 | 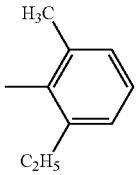 | 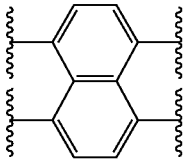 | 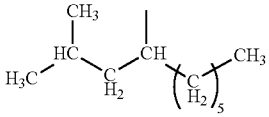 |

TABLE 1-continued
| Exemplified Compound | $R^1$ | X | $R^2$ |
|---|---|---|---|
| A107 | 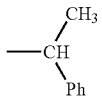 | 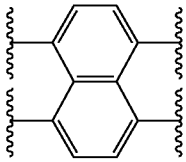 | 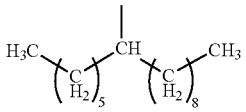 |
| A108 | 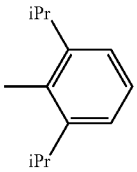 | 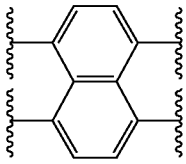 | 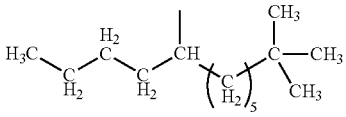 |
| A109 | 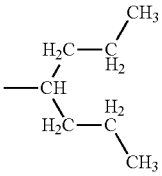 | 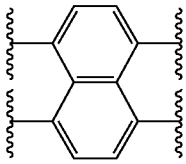 | 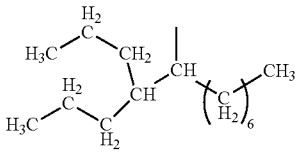 |
| A110 | 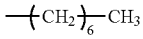 | 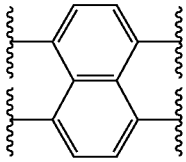 | 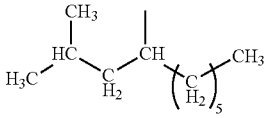 |
| A111 | 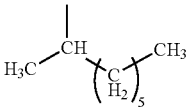 | 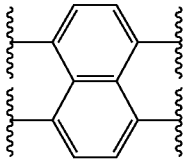 | 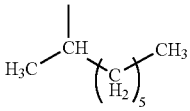 |
| A112 | 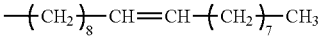 | 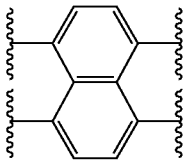 | 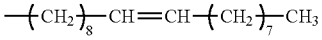 |
| A113 | 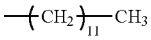 | 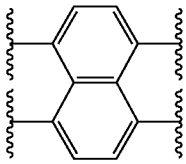 | 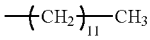 |
| A114 | 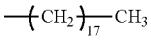 | 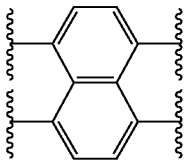 | 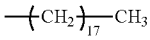 |

TABLE 1-continued
| Exemplified Compound | $R^1$ | X | $R^2$ |
|---|---|---|---|
| A115 | 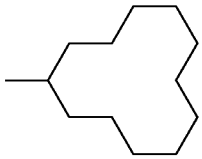 | 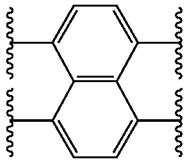 | 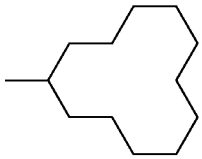 |
| B101 | 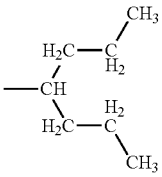 | 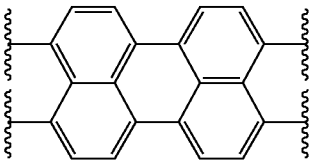 | 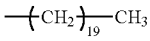 |
| B102 | 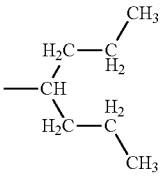 | 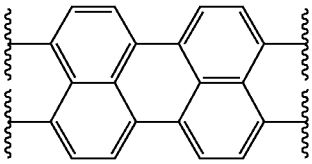 | 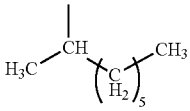 |
| B103 | 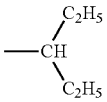 | 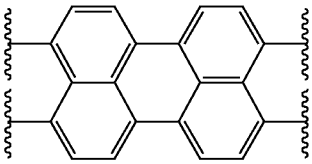 | 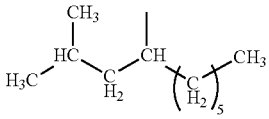 |
| B104 | 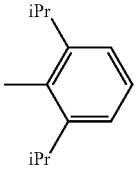 | 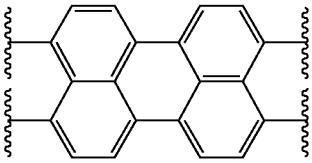 | 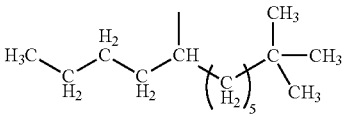 |
| B105 | 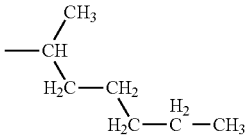 | 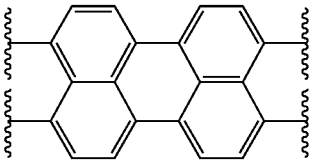 | 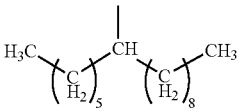 |
| B106 | 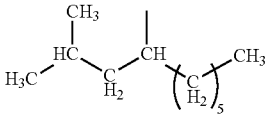 | 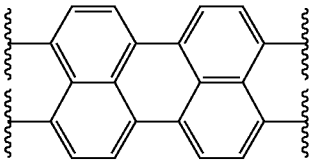 | 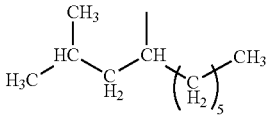 |
| B107 | 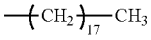 | 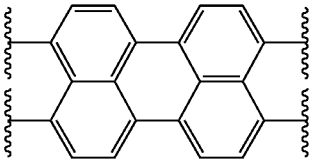 | 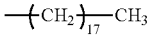 |

TABLE 1-continued
| Exemplified Compound | $R^1$ | X | $R^2$ |
|---|---|---|---|
| B108 | 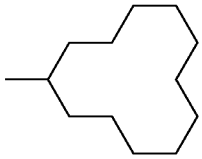 | 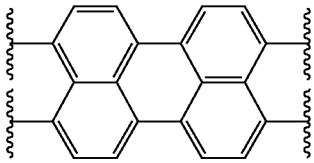 | 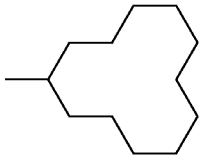 |
| C101 | 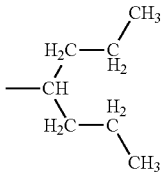 | 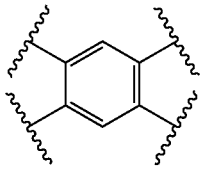 | 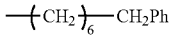 |
| C102 | 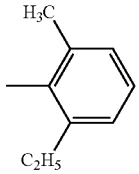 | 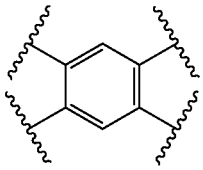 | 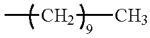 |
| C103 | 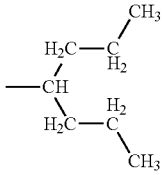 | 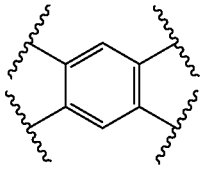 | 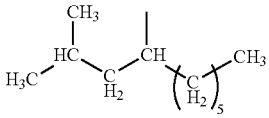 |
| C104 | 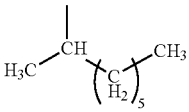 | 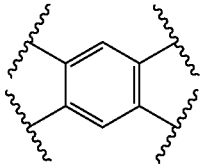 | 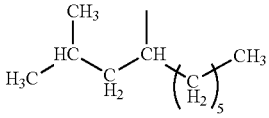 |
| C105 | 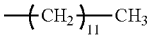 | 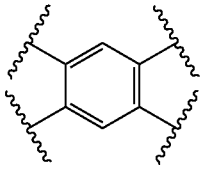 | 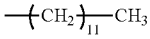 |
| C106 | 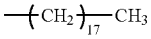 | 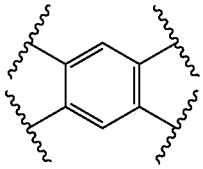 | 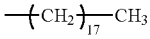 |
| C107 | 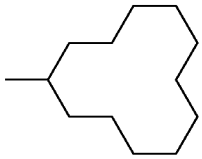 | 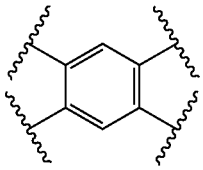 | 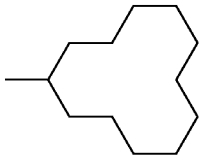 |

TABLE 1-continued
| Exemplified Compound | $R^1$ | X | $R^2$ |
|---|---|---|---|
| A201 | 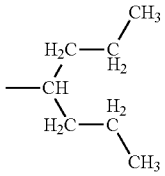 | 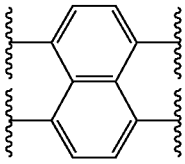 | 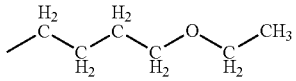 |
| A202 | 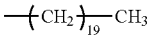 | 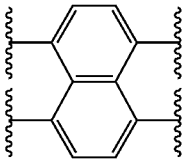 | 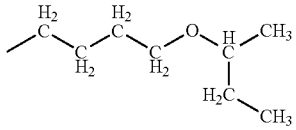 |
| A203 | 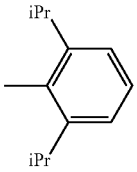 | 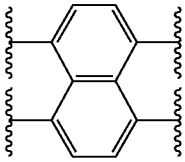 | 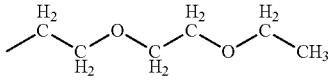 |
| A204 | 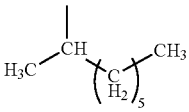 | 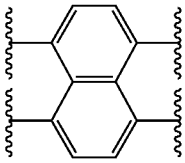 | 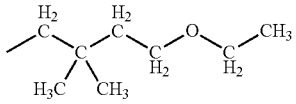 |
| A205 | 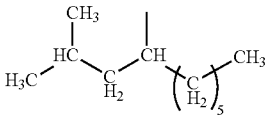 | 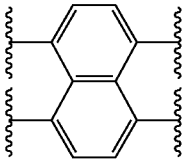 | 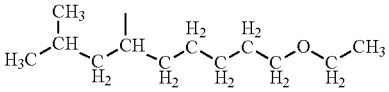 |
| A206 | 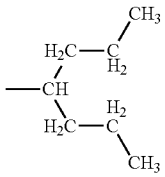 | 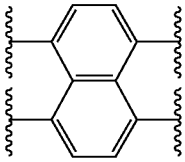 | 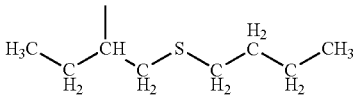 |
| A207 | 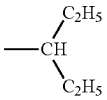 | 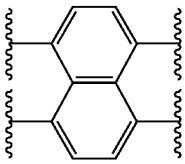 | 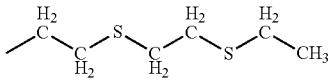 |
| A208 | 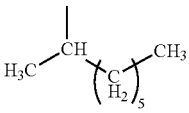 | 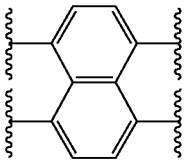 | 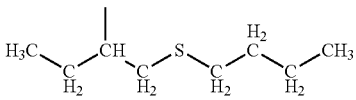 |

TABLE 1-continued
| Exemplified Compound | $R^1$ | X | $R^2$ |
|---|---|---|---|
| A209 | 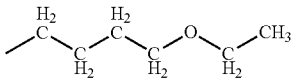 | 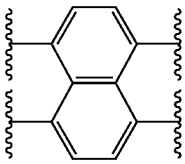 | 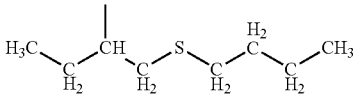 |
| A210 | 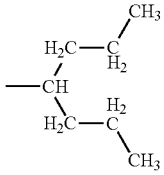 | 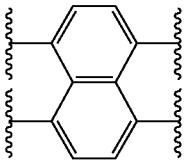 | 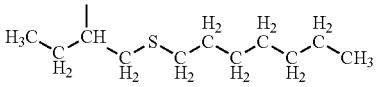 |
| A211 | 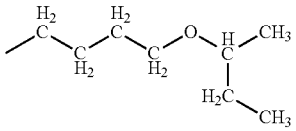 | 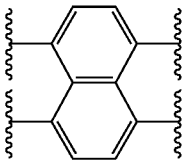 | 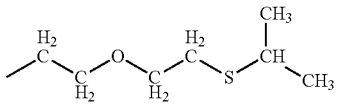 |
| A212 | 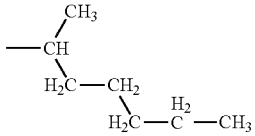 | 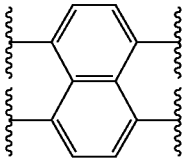 | 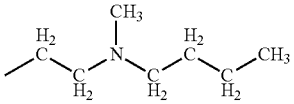 |
| A213 | 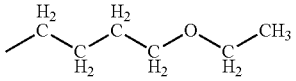 | 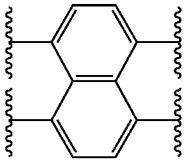 | 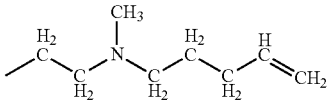 |
| A214 | 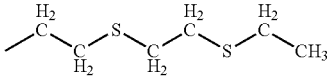 | 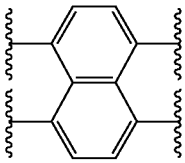 | 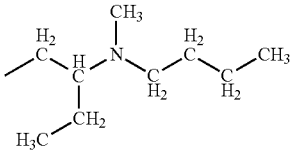 |
| A215 | 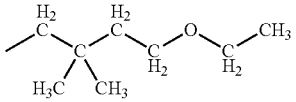 | 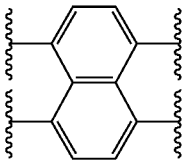 | 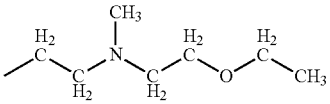 |
| A216 | 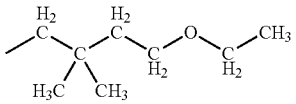 | 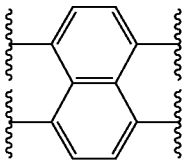 | 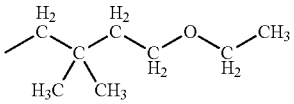 |

TABLE 1-continued
| Exemplified Compound | $R^1$ | X | $R^2$ |
|---|---|---|---|
| A217 | 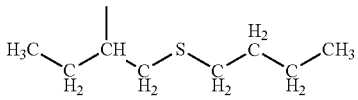 | 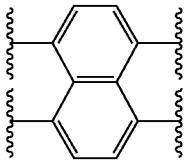 | 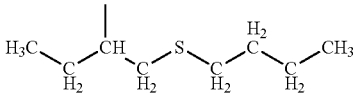 |
| A218 | 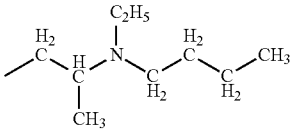 | 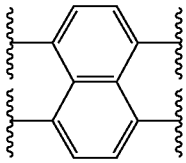 | 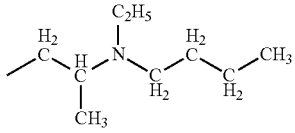 |
| A219 | 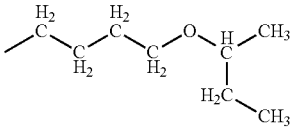 | 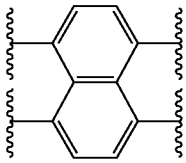 | 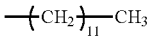 |
| A220 | 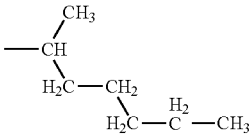 | 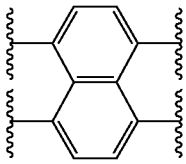 | 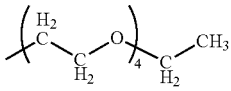 |
| A221 | 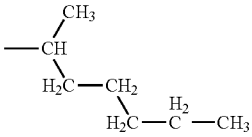 | 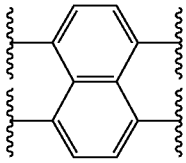 | 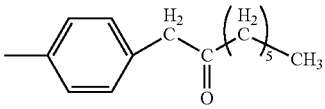 |
| B201 | 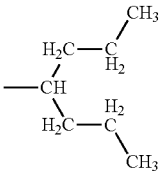 | 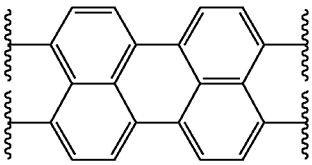 | 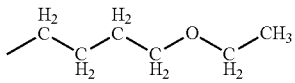 |
| B202 | 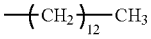 | 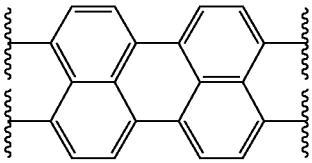 | 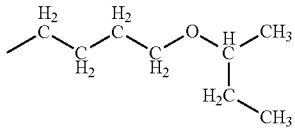 |
| B203 | 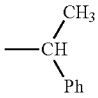 | 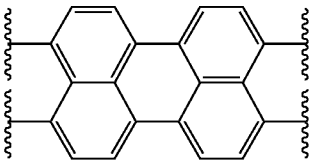 | 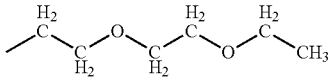 |

TABLE 1-continued
| Exemplified Compound | $R^1$ | X | $R^2$ |
|---|---|---|---|
| B204 | 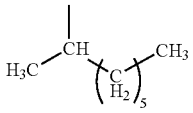 | 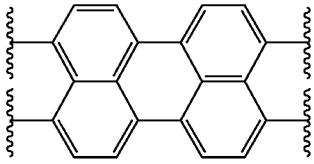 | 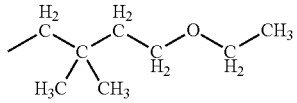 |
| B205 | 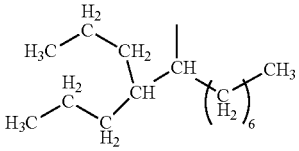 | 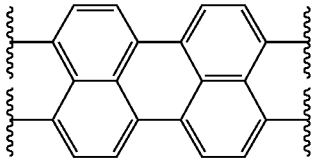 | 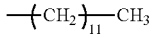 |
| B206 | 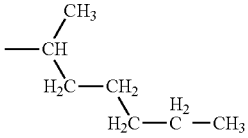 | 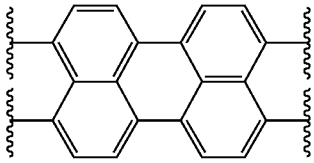 | 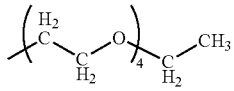 |
| B207 | 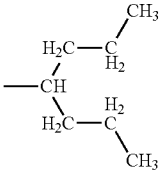 | 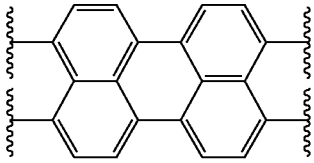 | 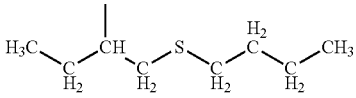 |
| B208 | 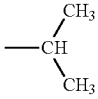 | 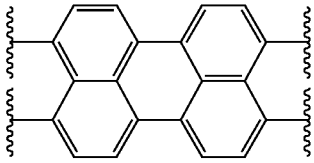 | 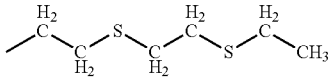 |
| B209 | 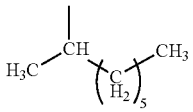 | 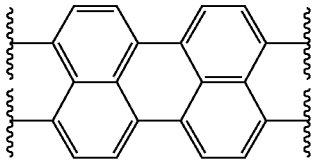 | 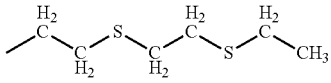 |
| B210 | 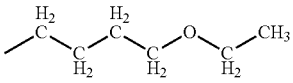 | 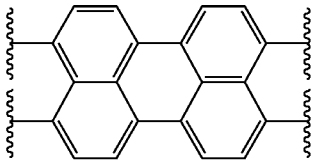 | 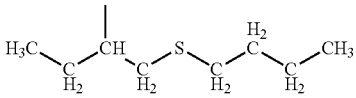 |
| B211 | 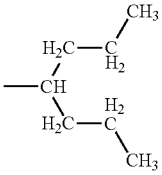 | 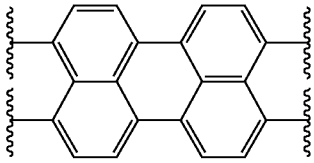 | 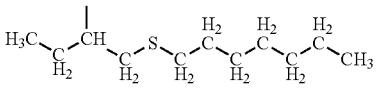 |

TABLE 1-continued
| Exemplified Compound | $R^1$ | X | $R^2$ |
|---|---|---|---|
| B212 | 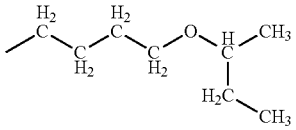 | 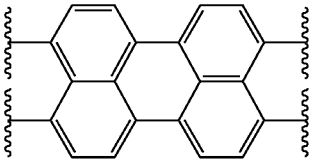 | 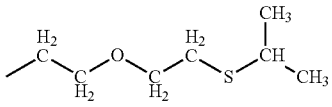 |
| B213 | 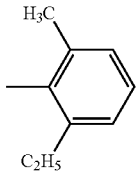 | 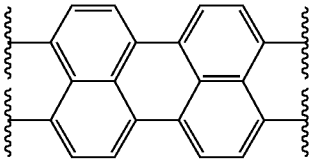 | 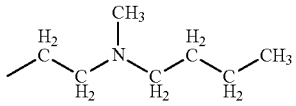 |
| B214 | 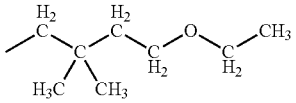 | 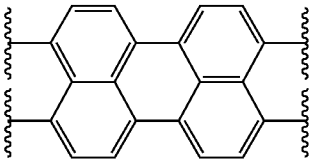 | 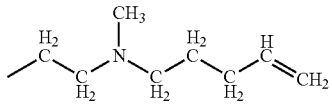 |
| B215 | 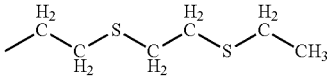 | 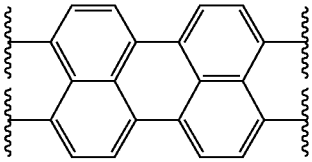 | 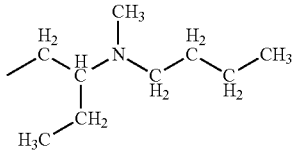 |
| B216 | 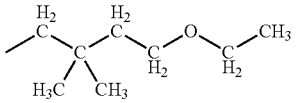 | 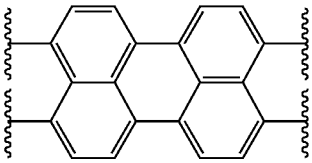 | 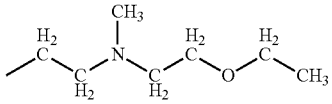 |
| B217 | 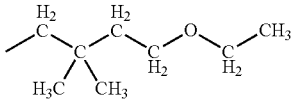 | 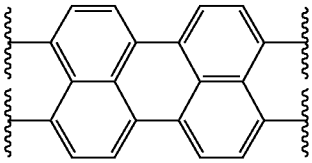 | 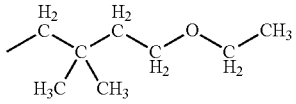 |
| B218 | 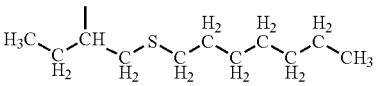 | 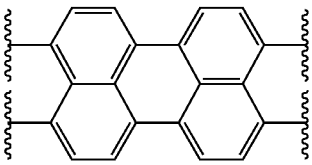 | 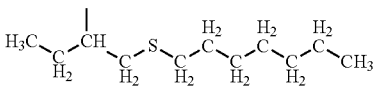 |
| B219 | 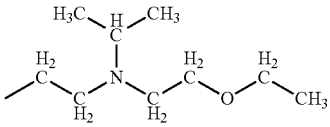 | 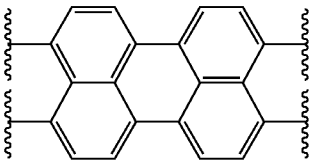 | 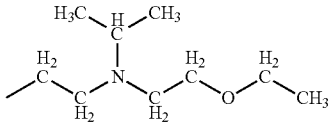 |

TABLE 1-continued
| Exemplified Compound | $R^1$ | X | $R^2$ |
|---|---|---|---|
| B220 | 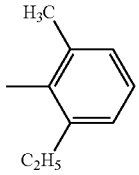 | 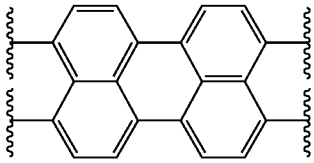 | 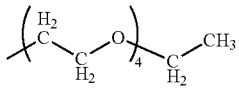 |
| B221 | 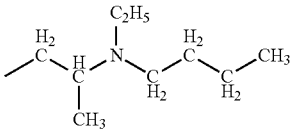 | 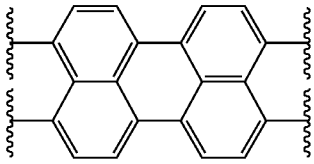 | 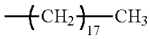 |
| C201 | 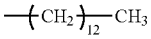 | 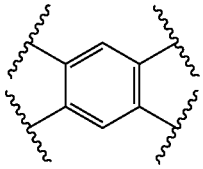 | 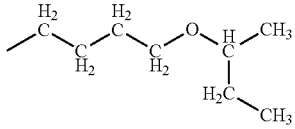 |
| C202 | 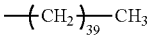 | 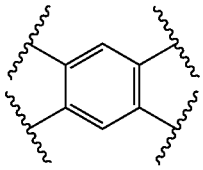 | 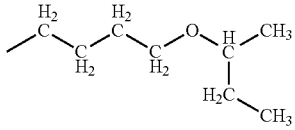 |
| C203 | 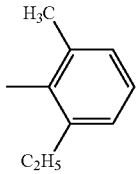 | 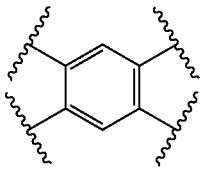 | 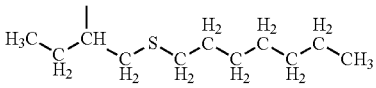 |
| C204 | 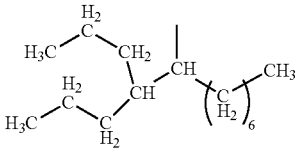 | 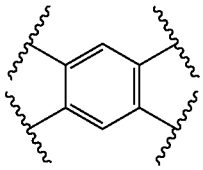 | 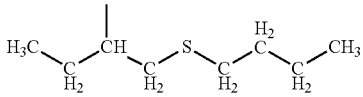 |
| C205 | 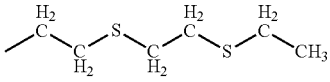 | 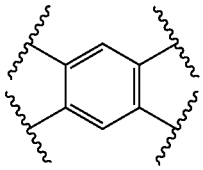 | 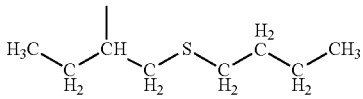 |
| C206 | 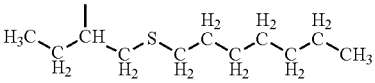 | 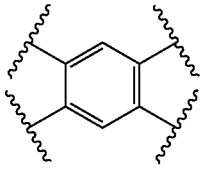 | 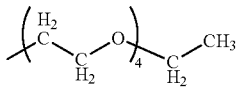 |

TABLE 1-continued
| Exemplified Compound | $R^1$ | X | $R^2$ |
|---|---|---|---|
| C207 | 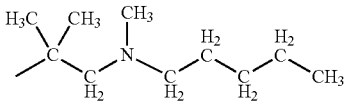 | 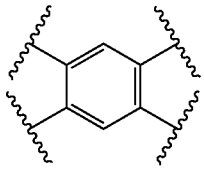 | 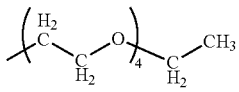 |
| C208 | 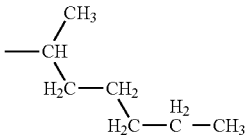 | 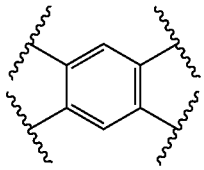 | 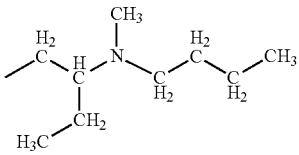 |
| C209 | 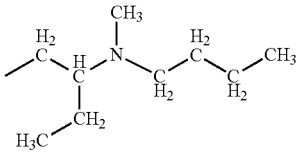 | 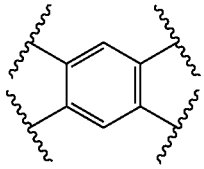 | 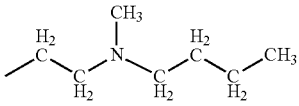 |
| C210 | 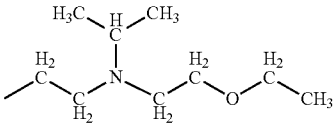 | 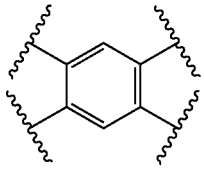 | 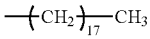 |
| A301 | 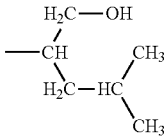 | 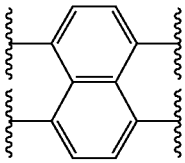 | 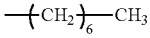 |
| A302 | 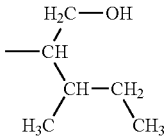 | 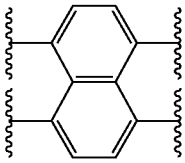 | 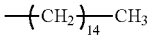 |
| A303 | 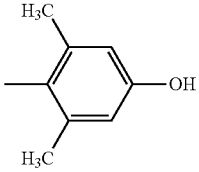 | 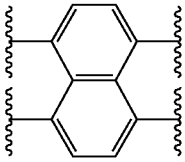 | 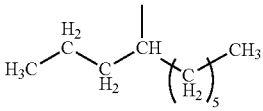 |
| A304 | 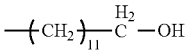 | 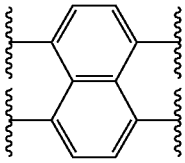 | 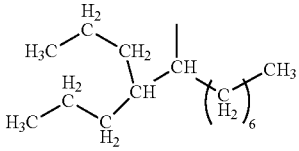 |

TABLE 1-continued
| Exemplified Compound | $R^1$ | X | $R^2$ |
|---|---|---|---|
| A305 | 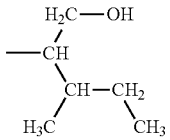 | 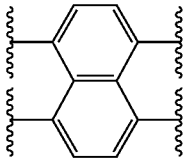 | 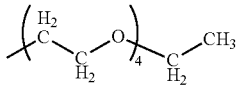 |
| A306 | 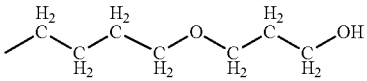 | 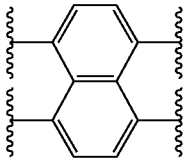 | 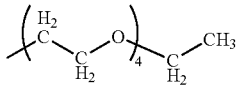 |
| A307 | 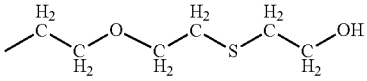 | 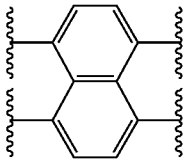 | 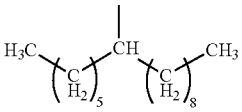 |
| A308 | 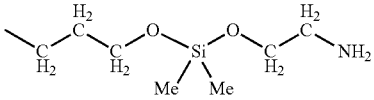 | 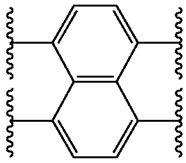 | 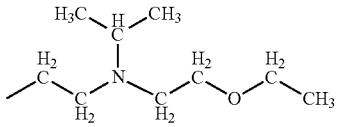 |
| A309 | 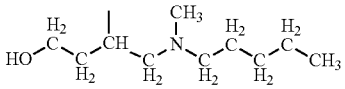 | 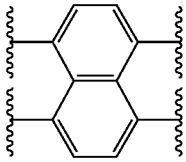 | 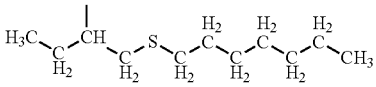 |
| A310 | 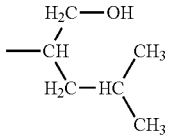 | 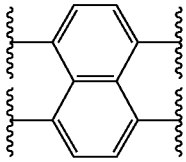 | 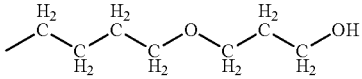 |
| A311 | 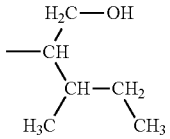 | 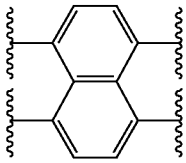 | 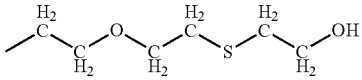 |
| A312 | 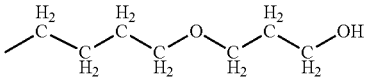 | 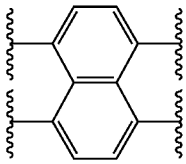 | 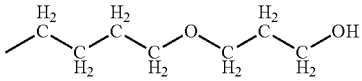 |

TABLE 1-continued
| Exemplified Compound | $R^1$ | X | $R^2$ |
|---|---|---|---|
| A313 | 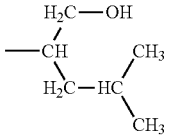 | 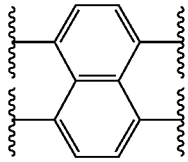 | 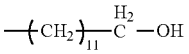 |
| B301 | 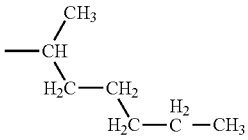 | 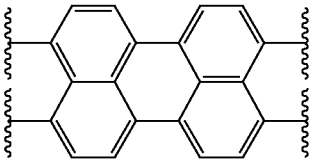 | 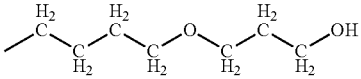 |
| B302 | 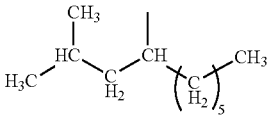 | 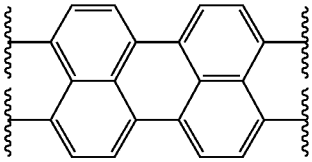 | 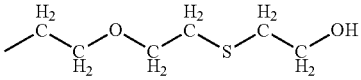 |
| B303 | 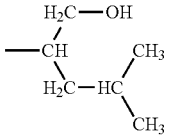 | 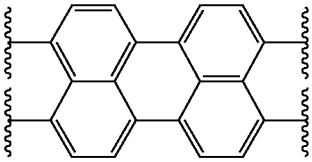 | 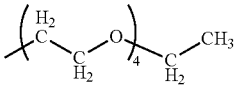 |
| B304 | 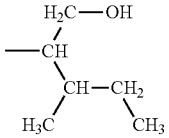 | 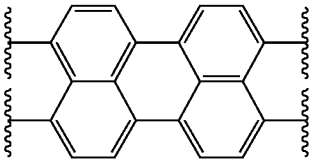 | 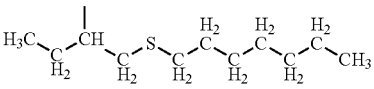 |
| B305 | 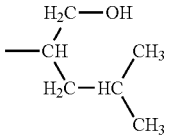 | 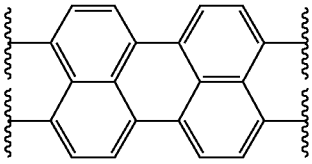 | 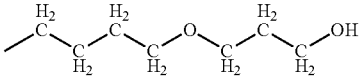 |
| B306 | 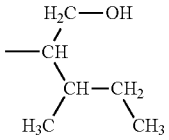 | 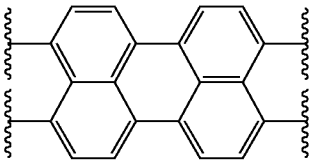 | 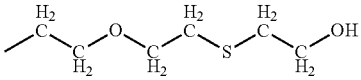 |
| B307 | 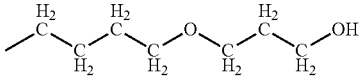 | 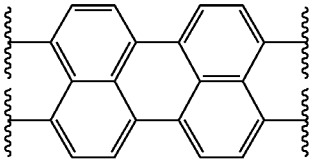 | 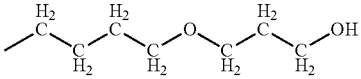 |

TABLE 1-continued
| Exemplified Compound | $R^1$ | X | $R^2$ |
|---|---|---|---|
| B308 | 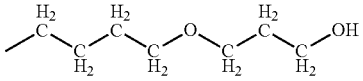 | 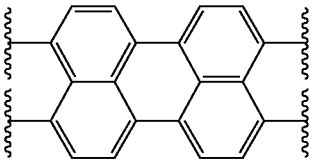 | 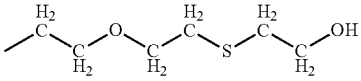 |
| C301 | 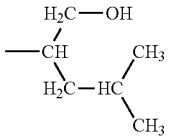 | 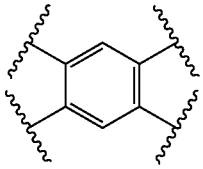 | 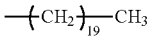 |
| C302 | 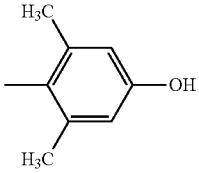 | 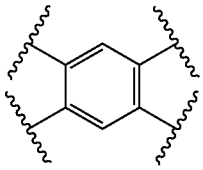 | 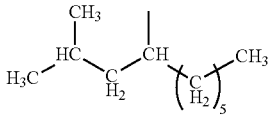 |
| C303 | 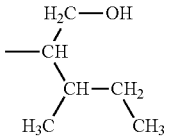 | 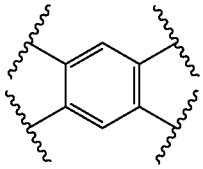 | 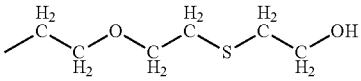 |
| C304 | 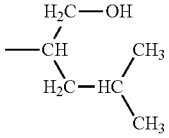 | 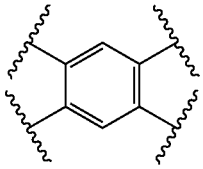 | 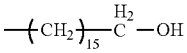 |
| C305 | 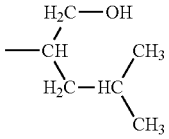 | 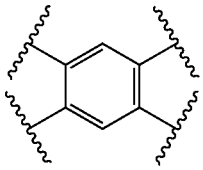 | 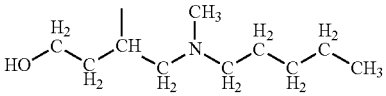 |
| C306 | 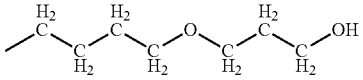 | 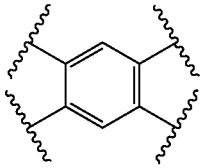 | 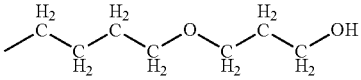 |
| C307 | 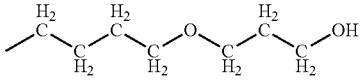 | 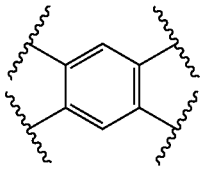 | 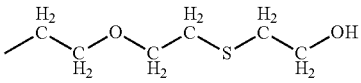 |

TABLE 1-continued
| Exemplified Compound | $R^1$ | X | $R^2$ |
|---|---|---|---|
| A401 | 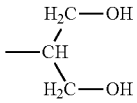 | 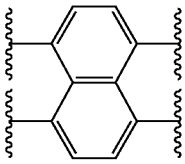 | 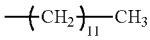 |
| A402 | 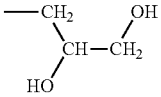 | 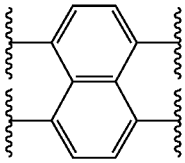 | 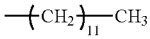 |
| A403 | 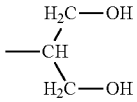 | 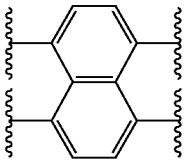 | 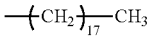 |
| A404 | 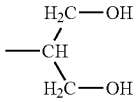 | 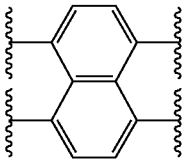 | 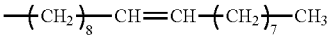 |
| A405 | 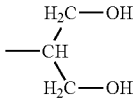 | 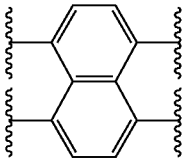 | 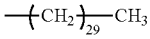 |
| A406 | 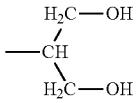 | 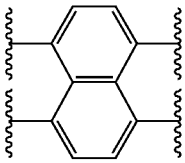 | 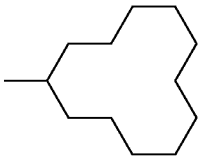 |
| A407 | 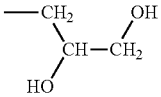 | 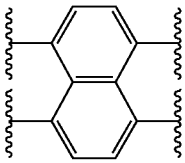 | 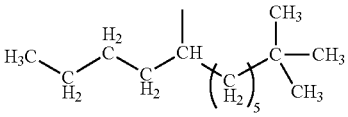 |
| A408 | 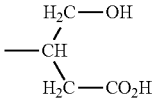 | 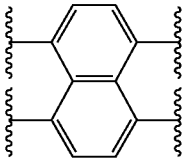 | 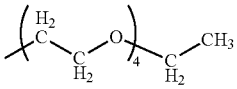 |

TABLE 1-continued
| Exemplified Compound | $R^1$ | X | $R^2$ |
|---|---|---|---|
| A409 | 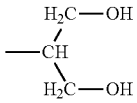 | 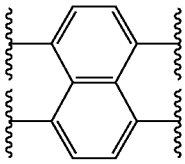 | 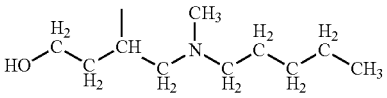 |
| A410 | 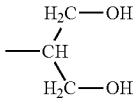 | 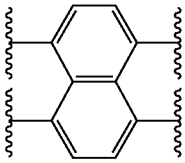 | 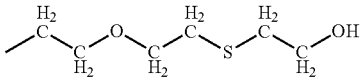 |
| A411 | 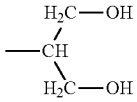 | 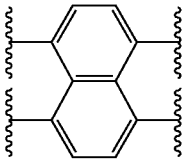 | 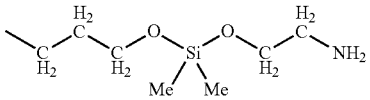 |
| A412 | 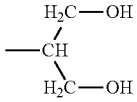 | 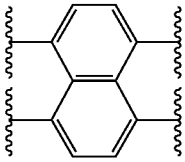 | 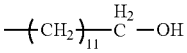 |
| A413 | 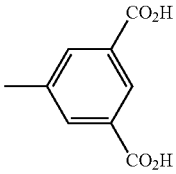 | 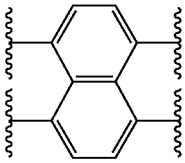 | 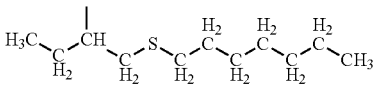 |
| B401 | 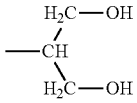 | 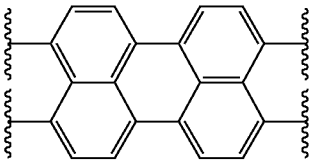 | 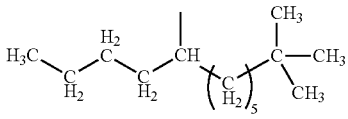 |
| B402 | 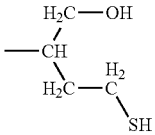 | 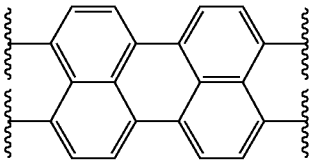 | 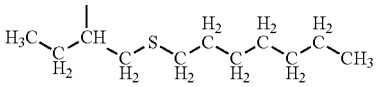 |
| B403 | 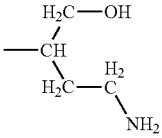 | 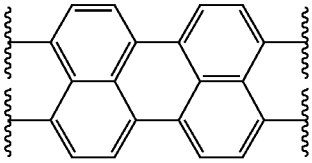 | 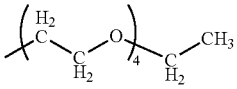 |

TABLE 1-continued
| Exemplified Compound | $R^1$ | X | $R^2$ |
|---|---|---|---|
| B404 | 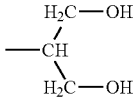 | 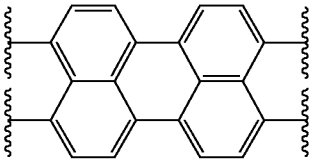 | 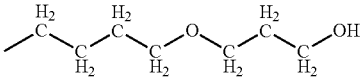 |
| B405 | 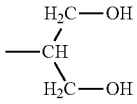 | 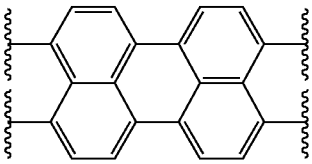 | 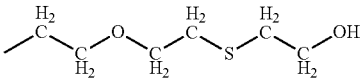 |
| B406 | 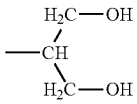 | 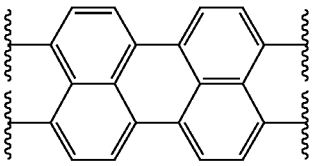 | 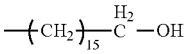 |
| C401 | 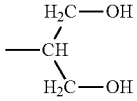 | 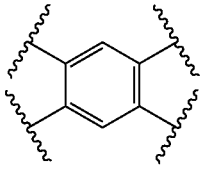 | 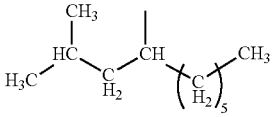 |
| C402 | 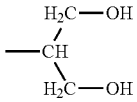 | 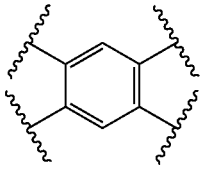 | 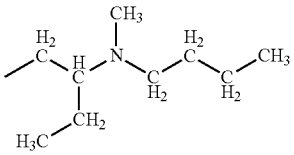 |
| C403 | 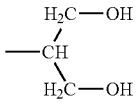 | 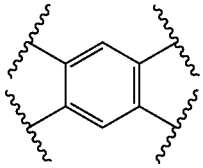 | 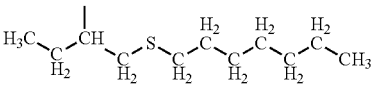 |
| C404 | 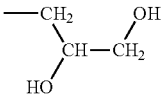 | 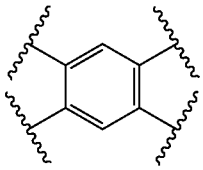 | 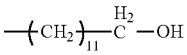 |
| C405 | 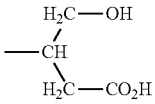 | 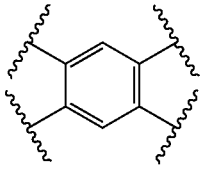 | 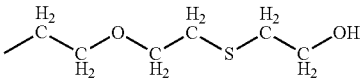 |

TABLE 1-continued
| Exemplified Compound | $R^1$ | X | $R^2$ |
|---|---|---|---|
| C406 | 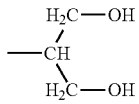 | 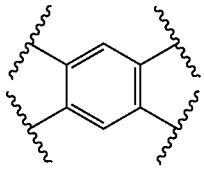 | 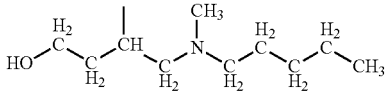 |
| A501 | 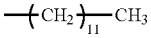 | 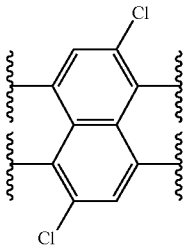 | 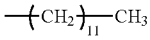 |
| A502 | 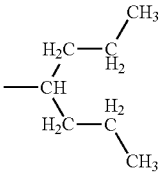 | 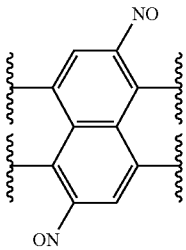 | 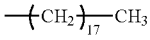 |
| A503 | 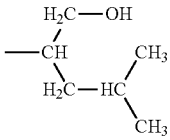 | 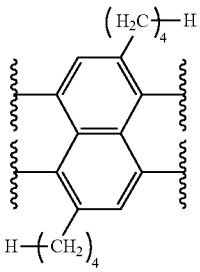 | 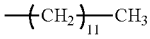 |
| A504 | 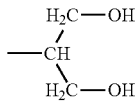 | 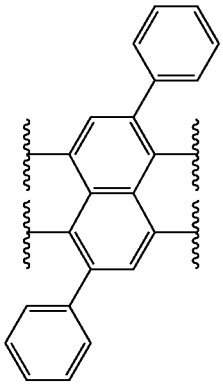 | 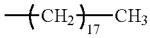 |

TABLE 1-continued
| Exemplified Compound | $R^1$ | X | $R^2$ |
|---|---|---|---|
| B501 | $-(CH_2)_{11}-CH_3$ | 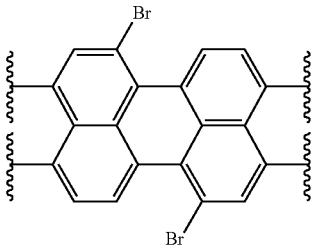 | $-(CH_2)_{11}-CH_3$ |
| B502 | 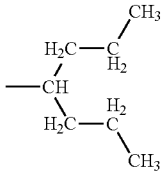 | 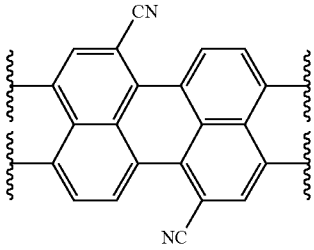 | $-(CH_2)_{17}-CH_3$ |
| B503 | 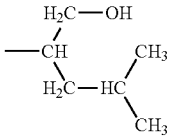 | 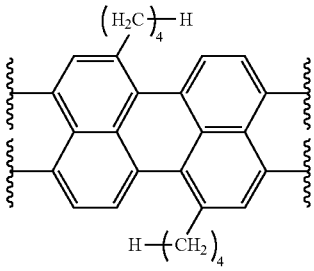 | $-(CH_2)_{11}-CH_3$ |
| B504 | 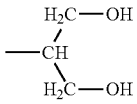 | 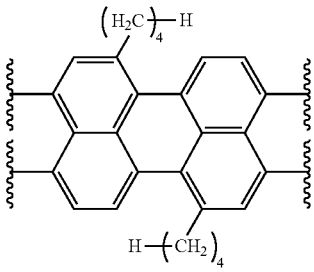 | $-(CH_2)_{17}-CH_3$ |
| C501 | $-(CH_2)_{11}-CH_3$ | 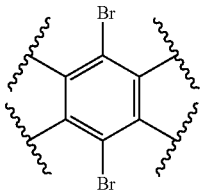 | $-(CH_2)_{11}-CH_3$ |
| C502 | 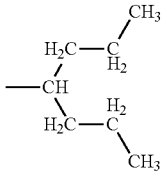 | 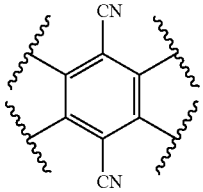 | $-(CH_2)_{17}-CH_3$ |

TABLE 1-continued

| Exemplified Compound | $R^1$ | X | $R^2$ |
|---|---|---|---|
| C503 | 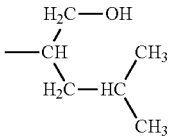 | 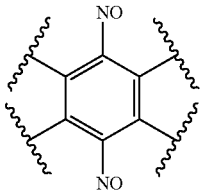 | 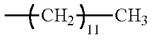 |
| C504 | 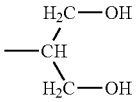 | 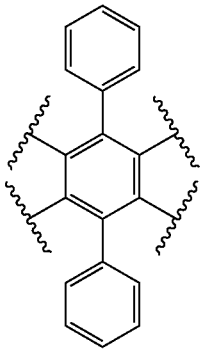 | 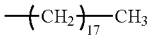 |

The identification of a compound or the like to be used in the present invention can also be performed by the following method.

Mass Spectrometry

A matrix-assisted laser desorption/ionization time-of-flight mass spectrometer (MALDI-TOF MS: ultraflex manufactured by Bruker Daltonics K.K.) was used. Conditions were as follows: acceleration voltage: 20 kV, mode: Reflector, and molecular weight standard: fullerene C60. A molecular weight was identified with the resultant peak top value.

[Photosensitive Layer]

The photosensitive layer containing the charge generating material and the hole transporting material is arranged on the undercoat layer.

The photosensitive layer containing the charge generating material and the hole transporting material comes in the following types: a photosensitive layer obtained by laminating a charge generating layer containing the charge generating material and a hole transporting layer containing the hole transporting material in this order from a support side (hereinafter sometimes referred to as "laminated photosensitive layer"); and a photosensitive layer obtained by incorporating the charge generating material and the hole transporting material into the same layer (hereinafter sometimes referred to as "single-layer photosensitive layer"). A plurality of the charge generating layers may be arranged, and a plurality of the hole transporting layers may also be arranged.

Examples of the charge generating material include an azo pigment, a perylene pigment, a quinone pigment, an indigoid pigment, a phthalocyanine pigment, and a perinone pigment. Of those, an azo pigment or a phthalocyanine pigment is preferred. Of the phthalocyanine pigments, oxytitanium phthalocyanine, chlorogallium phthalocyanine, or hydroxygallium phthalocyanine is preferred.

As a binder resin to be used for the charge generating layer in the case where the photosensitive layer is the laminated photosensitive layer, there are given, for example: a polymer and copolymer of a vinyl compound, such as styrene, vinyl acetate, vinyl chloride, an acrylic acid ester, a methacrylic acid ester, vinylidene fluoride, or trifluoroethylene; polyvinyl alcohol; polyvinyl acetal; polycarbonate; polyester; polysulfone; polyphenylene oxide; polyurethane; a cellulose resin; a phenol resin; a melamine resin; a silicon resin; and an epoxy resin. Of those, polyester, polycarbonate, and polyvinyl acetal are preferred, and polyvinyl acetal is more preferred.

In the charge generating layer, the mass ratio (charge generating material/binder resin) of the charge generating material to the binder resin falls within the range of preferably from 10/1 to 1/10, more preferably from 5/1 to 1/5.

The thickness of the charge generating layer is preferably 0.05 μm or more and 5 μm or less.

Examples of the hole transporting material include a polycyclic aromatic compound, a heterocyclic compound, a hydrazone compound, a styryl compound, a benzidine compound, a triarylamine compound, and triphenylamine. In addition, examples thereof also include a polymer having in its main chain or side chain a group resulting from any one of these compounds.

As a binder resin to be used for the hole transporting layer in the case where the photosensitive layer is the laminated photosensitive layer, there are given, for example, polyester, polycarbonate, polymethacrylate, polyarylate, polysulfone, and polystyrene. Of those, polycarbonate and polyarylate are preferred. In addition, it is preferred that the weight-average molecular weight (Mw) of any such binder resin fall within the range of from 10,000 to 300,000.

In the hole transporting layer, the mass ratio (hole transporting material/binder resin) of the hole transporting material to the binder resin falls within the range of preferably from 10/5 to 5/10, more preferably from 10/8 to 6/10.

Another layer, such as an electroconductive layer obtained by dispersing electroconductive particles made of a metal oxide, carbon black, or the like in a resin, or a second undercoat layer that does not contain the compound or the polymer to be used in the present invention, may be arranged between the support and the undercoat layer, or between the undercoat layer and the photosensitive layer.

In addition, a protective layer containing electroconductive particles or the hole transporting material and a binder resin may be arranged on the photosensitive layer (or in the case of the laminated photosensitive layer, the hole transporting layer). An additive, such as a lubricant, may be further incorporated into the protective layer. In addition, the resin (binder resin) itself of the protective layer may be provided with electroconductivity or a hole transporting property, and in this case, the electroconductive particles or the hole transporting material except the resin may not be incorporated into the protective layer. In addition, the binder resin of the protective layer may be a thermoplastic resin, or may be a curable resin that can be cured with heat, light, a radiation (e.g., an electron beam), or the like.

A method of forming each layer constituting the electrophotographic photosensitive member, such as the undercoat layer or the photosensitive layer, is preferably a method involving: applying a coating liquid obtained by dissolving and/or dispersing a material constituting each layer in a solvent; and drying and/or curing the resultant coating film to form the layer. A method of applying the coating liquid is, for example, an immersion application method (immersion coating method), a spray coating method, a curtain coating method, or a spin coating method. Of those, an immersion application method is preferred from the viewpoints of efficiency and productivity.

[Process Cartridge and Electrophotographic Apparatus]

FIG. 1 is a view for illustrating the schematic construction of an electrophotographic apparatus including a process cartridge including the electrophotographic photosensitive member of the present invention.

In FIG. 1, a drum-shaped electrophotographic photosensitive member 1 of the present invention is rotationally driven about a rotation axis 2 in a direction indicated by the arrow at a predetermined peripheral speed. The surface (peripheral surface) of the electrophotographic photosensitive member 1 is charged to a predetermined positive or negative potential by a charging unit 3 (e.g., a contact-type primary charger or a non-contact-type primary charger) in the course of its rotation. Next, the surface receives exposure light (image exposure light) 4 (e.g., laser light) from an exposing unit (image exposing unit) (not shown), such as slit exposure or laser beam scanning exposure. Thus, electrostatic latent images are sequentially formed on the surface of the electrophotographic photosensitive member 1.

Next, the formed electrostatic latent images are each developed with a toner of a developing unit 5 (e.g., a contact-type developing device or a non-contact-type developing machine). The resultant toner images are sequentially transferred onto a transfer material P (e.g., paper) by a transferring unit 6 (e.g., a transfer charger). The transfer material P is removed from a transfer material supplying portion (not shown) in synchronization with the rotation of the electrophotographic photosensitive member 1, and is fed to a gap between the electrophotographic photosensitive member 1 and the transferring unit 6.

The transfer material P onto which the toner images have been transferred is separated from the surface of the electrophotographic photosensitive member 1, and is introduced into a fixing unit 8 to undergo image fixation. Thus, the transfer material is printed out as a copied product (copy) to the outside of the electrophotographic apparatus.

The surface of the electrophotographic photosensitive member 1 after the transfer of the toner is subjected to the removal of a transfer residual toner by a cleaning unit 7 to be cleaned, and is subjected to an antistatic treatment by pre-exposure light from a pre-exposing unit (not shown). After that, the electrophotographic photosensitive member 1 is repeatedly used in image formation.

A scorotron charger or a corotron charger utilizing corona discharge may be used as the charging unit 3, or a contact-type charger including a charging member of, for example, a roller shape, a blade shape, or a brush shape may be used.

In the present invention, the electrophotographic photosensitive member 1 and at least one unit selected from the group consisting of components such as the charging unit 3, the developing unit 5, the transferring unit 6, and the cleaning unit 7 may be integrally combined to constitute a process cartridge. In addition, the process cartridge may be removably mounted onto the main body of an electrophotographic apparatus, such as a copying machine or a laser beam printer. For example, a cartridge is produced by integrally supporting at least one unit selected from the group consisting of the charging unit 3, the developing unit 5, the transferring unit 6, and the cleaning unit 7 together with the electrophotographic photosensitive member 1. Then, the cartridge can be turned into a process cartridge 9 removably mounted onto the main body of the electrophotographic apparatus by using guiding units, such as rails 10 of the main body of the electrophotographic apparatus.

EXAMPLES

Now, the present invention is described in more detail by way of Examples. The term "part(s)" in Examples refers to "part(s) by mass".

First, a synthesis example of the imide compound represented by the formula (1) is described.

Synthesis Example 1

Under a nitrogen atmosphere, 5.4 parts of naphthalenetetracarboxylic dianhydride and 12.9 parts of 9-octadecen-1-amine were loaded into 200 parts of dimethylacetamide, and the mixture was stirred at room temperature for 1 hour to prepare a solution. After having been prepared, the solution was refluxed for 10 hours and separated by silica gel column chromatography (developing solvent: ethyl acetate/toluene). After that, a fraction containing a target product was concentrated. The concentrate was recrystallized with a mixed solution of ethyl acetate and toluene to provide 12.3 parts of Exemplified Compound A112.

The measurement of the compound with a MALDI-TOF MS identified the molecular ion peak of A112.

Synthesis Example 2

Under a nitrogen atmosphere, 5.4 parts of naphthalenetetracarboxylic dianhydride, 4.5 parts of dodecylamine, and 2.2 parts of 2-amino-1,3-propanediol were loaded into 200 parts of dimethylacetamide, and the mixture was stirred at room temperature for 1 hour to prepare a solution. After having been prepared, the solution was refluxed for 10 hours and separated by silica gel column chromatography (developing solvent: ethyl acetate/toluene). After that, a fraction containing a target product was concentrated. The concentrate was recrystallized with a mixed solution of ethyl acetate and toluene to provide 8.2 parts of Exemplified Compound A401.

The measurement of the compound with a MALDI-TOF MS identified the molecular ion peak of A401.

Next, the production and evaluation of an electrophotographic photosensitive member are described.

The imide compound of the present invention except the imide compounds represented by A112 and A401 can also be synthesized by the same method as the above-mentioned method through the selection of a raw material corresponding to its structure.

Next, the production and evaluation of an electrophotographic photosensitive member are described.

Example 1

An aluminum cylinder having a length of 260.5 mm and a diameter of 30 mm (JIS-A3003, aluminum alloy) was used as a support (electroconductive support).

Next, 50 parts of titanium oxide particles covered with oxygen-deficient tin oxide (powder resistivity: 120 Ω·cm, tin oxide coverage: 40%), 40 parts of a phenol resin (PRIOPHEN J-325, manufactured by DIC Corporation, resin solid content: 60%), and 55 parts of methoxypropanol were loaded into a sand mill using glass beads each having a diameter of 1 mm, and were subjected to a dispersion treatment for 3 hours to prepare a coating liquid for an electroconductive layer.

The average particle diameter of the titanium oxide particles covered with oxygen-deficient tin oxide in the coating liquid for an electroconductive layer was measured through the use of a particle size distribution meter manufactured by Horiba, Ltd. (trade name: CAPA700) and tetrahydrofuran serving as a dispersion medium at a number of revolutions of 5,000 rpm by a centrifugal sedimentation method. As a result, the average particle diameter was 0.30 μm.

The coating liquid for an electroconductive layer was applied onto the support by immersion, and the resultant coating film was dried and thermally cured for 30 minutes at 160° C. to form an electroconductive layer having a thickness of 18 μm.

Next, 3 parts of Exemplified Compound A112 obtained in Synthesis Example 1 and 3 parts of a polyvinyl acetal resin (trade name: KS-5Z, manufactured by Sekisui Chemical Co., Ltd.) were dissolved in a mixed solvent of 47 parts of o-xylene and 47 parts of tetrahydrofuran. 0.12 Part of a slurry obtained by dispersing silica particles in isopropanol (trade name: IPA-ST-UP, silica ratio: 15 mass %, manufactured by Nissan Chemical Industries, Ltd.) was added to the solution, and the mixture was stirred to prepare a coating liquid for an undercoat layer.

(A112)

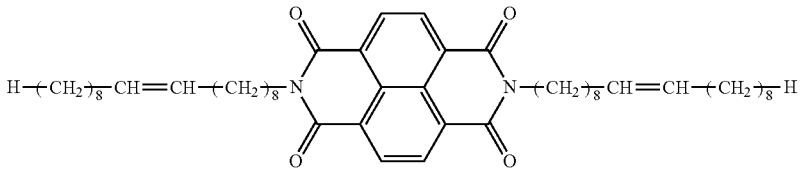

The coating liquid for an undercoat layer thus obtained was applied onto the support having formed thereon the electroconductive layer by immersion, and the resultant coating film was heated at 130° C. for 30 minutes to form an undercoat layer having a thickness of 0.6 μm.

Next, a hydroxygallium phthalocyanine crystal (charge generating material) of a crystal form having peaks at Bragg angles (2θ±0.2°) in CuKα characteristic X-ray diffraction of 7.5°, 9.9°, 12.5°, 16.3°, 18.6°, 25.1°, and 28.3° was prepared. 10 Parts of the hydroxygallium phthalocyanine crystal, 5 parts of polyvinyl butyral (trade name: S-LEC BX-1, manufactured by Sekisui Chemical Co., Ltd.), and 250 parts of cyclohexanone were loaded into a sand mill using glass beads each having a diameter of 1 mm, and the mixture was subjected to a dispersion treatment for 2 hours. Next, 250 parts of ethyl acetate was added to the resultant to prepare a coating liquid for a charge generating layer.

The coating liquid for a charge generating layer was applied onto the undercoat layer by immersion to form a coating film, and the resultant coating film was dried for 10 minutes at 95° C. to form a charge generating layer having a thickness of 0.2 μm.

Next, a coating liquid for a hole transporting layer was prepared by dissolving 6 parts of an amine compound (hole transporting material) represented by the formula (2), 2 parts of an amine compound (hole transporting material) represented by the formula (3), and 10 parts of a polyester resin having structural units represented by the formula (4) and the formula (5) at a ratio of 5/5 and having a weight-average molecular weight (Mw) of 100,000 in a mixed solvent of 40 parts of dimethoxymethane and 60 parts of chlorobenzene.

(2)

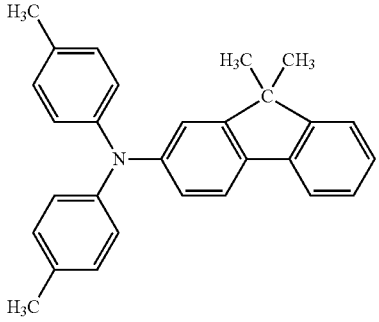

-continued (3)

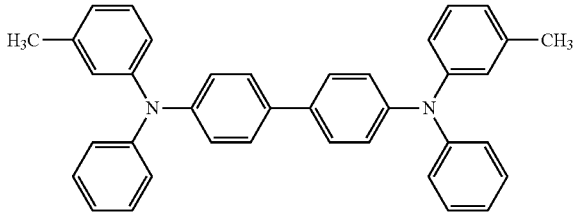

(4)

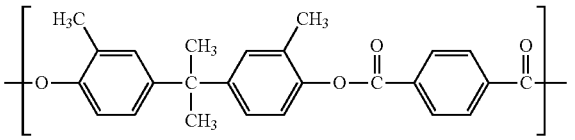

(5)

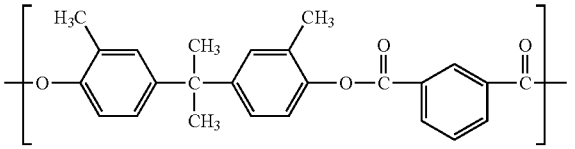

The coating liquid for a hole transporting layer was applied onto the charge generating layer by immersion, and the resultant coating film was dried for 40 minutes at 120° C. to form a hole transporting layer having a thickness of 15 μm.

Thus, an electrophotographic photosensitive member including, on the support, the electroconductive layer, the undercoat layer, the charge generating layer, and the hole transporting layer was produced.

The produced electrophotographic photosensitive member was mounted in a reconstructed apparatus of a laser beam printer manufactured by Canon Inc. (trade name: LBP-2510) under an environment having a temperature of 15° C. and a humidity of 10% RH. Then, the measurement of its surface potentials and the evaluations of output images were performed. Details about the foregoing are as described below.

For the measurement of the surface potentials, the process cartridge for a cyan color of the laser beam printer was reconstructed, and a potential probe (model 6000B-8: manufactured by Trek Japan) was mounted at its developing position. Further, the potential of the central portion of the electrophotographic photosensitive member was measured with a surface potentiometer (model 344: manufactured by Trek Japan). As surface potentials of a drum of the electrophotographic photosensitive member, the light quantity of image exposure was set so that the initial dark potential (Vd) and initial light potential (Vl) became −500 V and −100 V, respectively.

Subsequently, the produced electrophotographic photosensitive member was mounted in the process cartridge for a cyan color of the laser beam printer, and the process cartridge was mounted onto the station of the cyan process cartridge to output an image. First, 1 solid white image, 5 images for a ghost evaluation, 1 solid black image, and 5 images for a ghost evaluation were continuously output in the stated order. Next, a full-color image (letter image having a print percentage of each color of 1%) was output on 10,000 sheets of A4 size plain paper. After that, 1 solid white image, 5 images for a ghost evaluation, 1 solid black image, and 5 images for a ghost evaluation were continuously output in the stated order.

Figure 2:
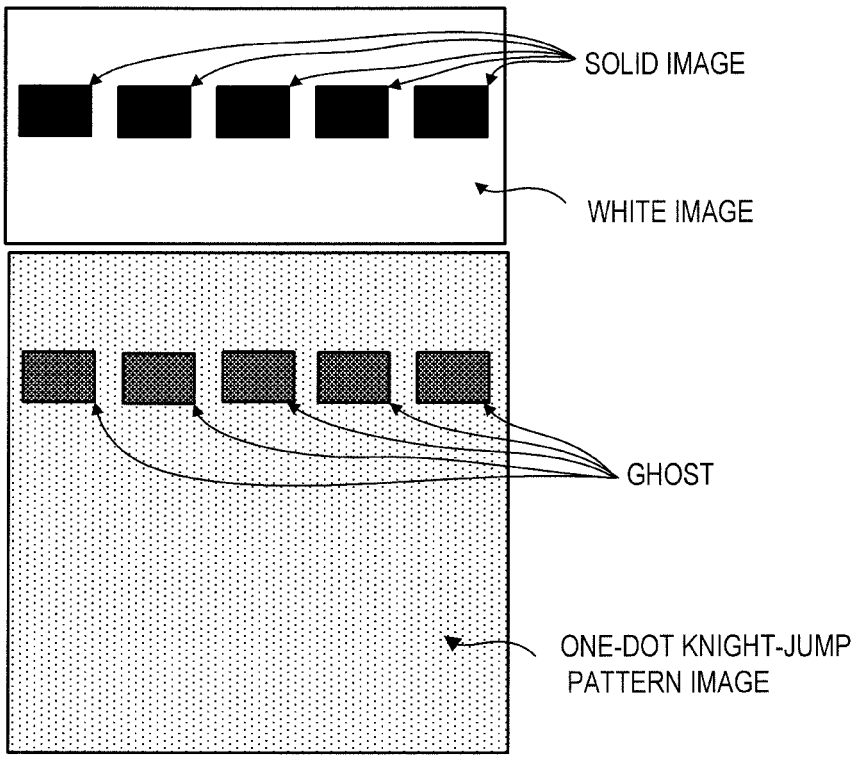
FIG. 2 is a view for illustrating an image for a ghost evaluation (printing for a ghost evaluation).
Figure 3:
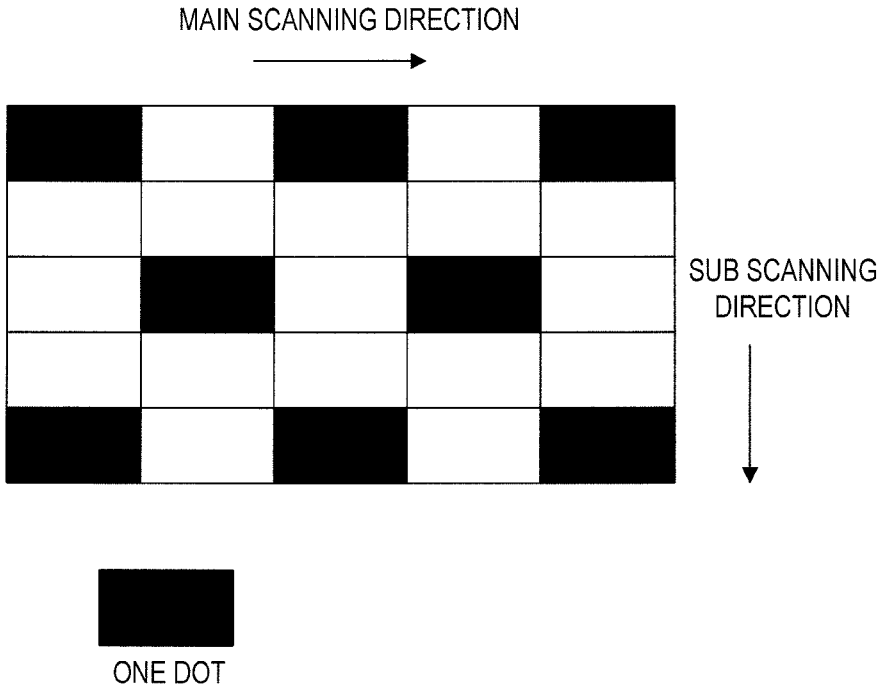
FIG. 3 is a view for illustrating a one-dot knight-jump pattern image.

The images for a ghost evaluation are each obtained by producing a "one-dot knight-jump pattern halftone image" illustrated in FIG. 3 after the output of a quadrangular "solid image" in a "white image" in the front portion of an image as illustrated in FIG. 2. In FIG. 2, a "ghost" portion is a portion in which a ghost resulting from the "solid image" may appear.

An evaluation for a positive ghost was performed by measuring a density difference between the image density of the one-dot knight-jump pattern halftone image and the image density of the ghost portion. Density differences were measured at 10 points in 1 image for a ghost evaluation with a spectral densitometer (trade name: X-Rite 504/508, manufactured by X-Rite). The operation was performed for all of the 10 images for a ghost evaluation, and a Macbeth density difference (initial) at the time of the output of an initial image was evaluated by calculating the average of density differences measured at a total of 100 points. Next, a fluctuation in Macbeth density difference was determined by calculating a difference (change) between a Macbeth density difference after the output on 10,000 sheets and the Macbeth density difference at the time of the output of the initial image. A smaller Macbeth density difference means that the positive ghost is suppressed to a larger extent. In addition, a smaller difference between the Macbeth density difference after the output on 10,000 sheets and the Macbeth density difference at the time of the output of the initial image means that a fluctuation in positive ghost is smaller. The results are shown in Table 2.

Examples 2 to 18

Photosensitive members were each produced in the same manner as in Example 1 except that the kinds and parts by mass of the compound represented by the formula (1) and the resin to be mixed in the coating liquid for an undercoat layer were changed as shown in Table 2, and the photosensitive members were evaluated in the same manner as in Example 1. The results are shown in Table 2.

Example 19

An electrophotographic photosensitive member was produced in the same manner as in Example 1 except that its undercoat layer was formed by the following operations, and the electrophotographic photosensitive member was evaluated in the same manner as in Example 1. The results are shown in Table 2.

3 Parts of Exemplified Compound A401 obtained in Synthesis Example 2, 1 part of a polyvinyl acetal resin (trade name: KS-5Z, manufactured by Sekisui Chemical Co., Ltd.), 2 parts of a blocked isocyanate compound (trade name: SBN-70D, manufactured by Asahi Kasei Chemicals Corporation), and 0.05 part of zinc(II) hexanoate (trade name: Zinc(II) Hexanoate, manufactured by Mitsuwa Chemicals Co., Ltd.) were dissolved in a mixed solvent of 47 parts of 1-methoxy-2-propanol and 47 parts of tetrahydrofuran. 0.12 Part of a slurry obtained by dispersing silica particles in isopropanol (trade name: IPA-ST-UP, silica ratio: 15 mass %, manufactured by Nissan Chemical Industries, Ltd.) was added to the solution, and the mixture was stirred to prepare a coating liquid for an undercoat layer.

(A401)

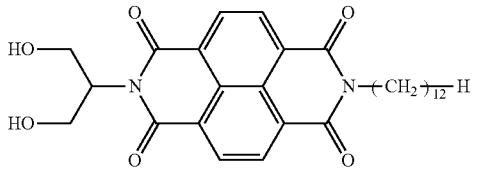

The coating liquid for an undercoat layer thus obtained was applied onto the support by immersion, and the resultant coating film was heated at 150° C. for 20 minutes to form an undercoat layer having a thickness of 0.6 μm.

Examples 20 to 41

Photosensitive members were each produced in the same manner as in Example 19 except that the kinds and parts by mass of the compound represented by the formula (1) and the resin to be mixed in the coating liquid for an undercoat layer were changed as shown in Table 2, and the photosensitive members were evaluated in the same manner as in Example 19. The results are shown in Table 2.

Comparative Example 1

An electrophotographic photosensitive member was produced in the same manner as in Example 1 except that the compound represented by the formula (1) to be mixed in the coating liquid for an undercoat layer was changed to a compound represented by the formula (6), and the electrophotographic photosensitive member was evaluated in the same manner as in Example 1. The results are shown in Table 3.

(6)

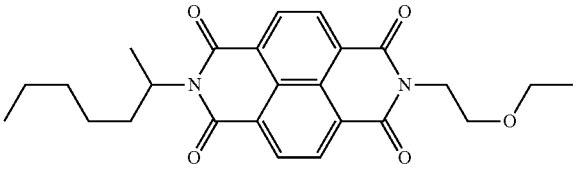

Comparative Example 2

An electrophotographic photosensitive member was produced in the same manner as in Example 1 except that the compound represented by the formula (1) to be mixed in the coating liquid for an undercoat layer was changed to a compound represented by the formula (7), and the electrophotographic photosensitive member was evaluated in the same manner as in Example 1. The results are shown in Table 3.

(7)

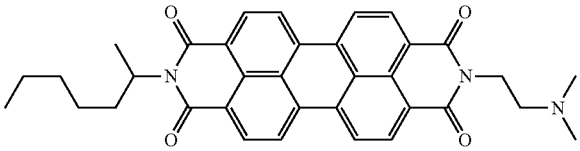

Comparative Example 3

An electrophotographic photosensitive member was produced in the same manner as in Example 1 except that the compound represented by the formula (1) to be mixed in the coating liquid for an undercoat layer was changed to a compound represented by the formula (8), and the electrophotographic photosensitive member was evaluated in the same manner as in Example 1. The results are shown in Table 3.

(8)

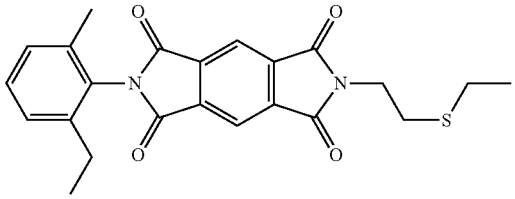

Comparative Example 4

An electrophotographic photosensitive member was produced in the same manner as in Example 1 except that the compound represented by the formula (1) to be mixed in the coating liquid for an undercoat layer was changed to a compound represented by the formula (9), and the electrophotographic photosensitive member was evaluated in the same manner as in Example 1. The results are shown in Table 3.

(9)

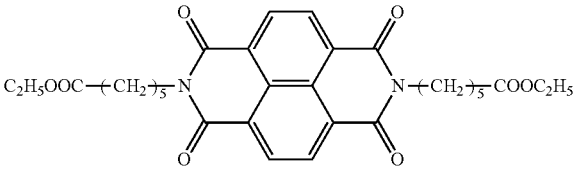

Comparative Example 5

An electrophotographic photosensitive member was produced in the same manner as in Example 1 except that the compound represented by the formula (1) to be mixed in the coating liquid for an undercoat layer was changed to a compound represented by the formula (10), and the electrophotographic photosensitive member was evaluated in the same manner as in Example 1. The results are shown in Table 3.

(10)

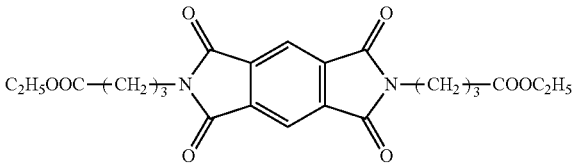

Comparative Example 6

An electrophotographic photosensitive member was produced in the same manner as in Example 19 except that the compound represented by the formula (1) to be mixed in the coating liquid for an undercoat layer was changed to a compound represented by the formula (11), and the electrophotographic photosensitive member was evaluated in the same manner as in Example 19. The results are shown in Table 3.

(11)

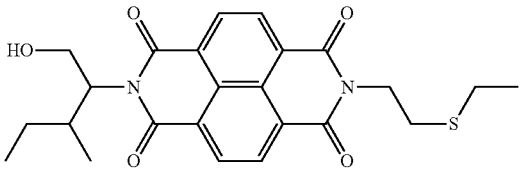

Comparative Example 7

An electrophotographic photosensitive member was produced in the same manner as in Example 19 except that the compound represented by the formula (1) to be mixed in the coating liquid for an undercoat layer was changed to a compound represented by the formula (12), and the electrophotographic photosensitive member was evaluated in the same manner as in Example 19. The results are shown in Table 3.

(12)

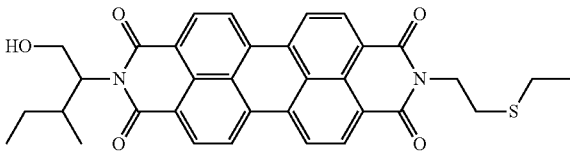

Comparative Example 8

An electrophotographic photosensitive member was produced in the same manner as in Example 19 except that the compound represented by the formula (1) to be mixed in the coating liquid for an undercoat layer was changed to a compound represented by the formula (13), and the electrophotographic photosensitive member was evaluated in the same manner as in Example 19. The results are shown in Table 3.

(13)

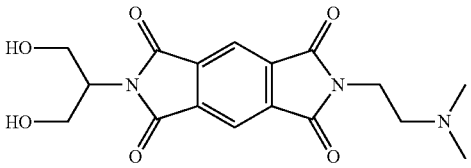

Comparative Example 9

An electrophotographic photosensitive member was produced in the same manner as in Example 19 except that the compound represented by the formula (1) to be mixed in the coating liquid for an undercoat layer was changed to a compound represented by the formula (14), and the electrophotographic photosensitive member was evaluated in the same manner as in Example 19. The results are shown in Table 3.

(14)

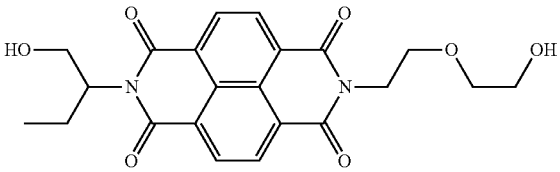

TABLE 2

| | Compound (1) | | Resin | | Crosslinking agent | | Macbeth density difference | |
|---|---|---|---|---|---|---|---|---|
| Example | Kind | Part(s) by mass | Kind | Part(s) by mass | Kind | Part(s) by mass | Initial density | Change |
| 1 | A112 | 3 | Resin 1 | 3 | — | — | 0.022 | 0.002 |
| 2 | A103 | 3 | Resin 1 | 3 | — | — | 0.023 | 0.003 |
| 3 | A107 | 3 | Resin 1 | 3 | — | — | 0.024 | 0.005 |
| 4 | A108 | 3 | Resin 1 | 3 | — | — | 0.025 | 0.006 |
| 5 | B102 | 3 | Resin 2 | 3 | — | — | 0.027 | 0.004 |
| 6 | B103 | 3 | Resin 2 | 3 | — | — | 0.024 | 0.006 |
| 7 | C103 | 3 | Resin 3 | 3 | — | — | 0.026 | 0.005 |
| 8 | A201 | 3 | Resin 2 | 3 | — | — | 0.027 | 0.005 |
| 9 | A205 | 3 | Resin 2 | 3 | — | — | 0.025 | 0.002 |
| 10 | A210 | 3 | Resin 2 | 3 | — | — | 0.023 | 0.007 |
| 11 | A218 | 3 | Resin 1 | 3 | — | — | 0.025 | 0.001 |
| 12 | A220 | 3 | Resin 1 | 3 | — | — | 0.024 | 0.005 |
| 13 | B206 | 3 | Resin 1 | 3 | — | — | 0.024 | 0.006 |
| 14 | B215 | 3 | Resin 2 | 3 | — | — | 0.020 | 0.002 |
| 15 | B221 | 3 | Resin 2 | 3 | — | — | 0.028 | 0.001 |
| 16 | C202 | 3 | Resin 2 | 3 | — | — | 0.022 | 0.013 |
| 17 | C203 | 3 | Resin 2 | 3 | — | — | 0.021 | 0.006 |
| 18 | C206 | 3 | Resin 1 | 3 | — | — | 0.022 | 0.002 |
| 19 | A401 | 3 | Resin 1 | 1 | Crosslinking agent 1 | 2 | 0.022 | 0.005 |

TABLE 2-continued

| | Compound (1) | | Resin | | Crosslinking agent | | Macbeth density difference | |
|---|---|---|---|---|---|---|---|---|
| Example | Kind | Part(s) by mass | Kind | Part(s) by mass | Kind | Part(s) by mass | Initial density | Change |
| 20 | A404 | 3 | Resin 1 | 1 | Crosslinking agent 1 | 2 | 0.026 | 0.004 |
| 21 | A406 | 3 | Resin 1 | 1 | Crosslinking agent 1 | 2 | 0.024 | 0.007 |
| 22 | A411 | 3 | Resin 1 | 1 | Crosslinking agent 1 | 2 | 0.026 | 0.005 |
| 23 | B402 | 3 | Resin 2 | 1 | Crosslinking agent 2 | 2 | 0.023 | 0.006 |
| 24 | B405 | 3 | Resin 2 | 1 | Crosslinking agent 2 | 2 | 0.021 | 0.006 |
| 25 | C401 | 3 | Resin 3 | 1 | Crosslinking agent 2 | 2 | 0.022 | 0.005 |
| 26 | C402 | 3 | Resin 2 | 1 | Crosslinking agent 1 | 2 | 0.028 | 0.007 |
| 27 | A302 | 3 | Resin 2 | 1 | Crosslinking agent 1 | 2 | 0.027 | 0.008 |
| 28 | A305 | 3 | Resin 2 | 1 | Crosslinking agent 1 | 2 | 0.022 | 0.005 |
| 29 | A308 | 3 | Resin 1 | 1 | Crosslinking agent 2 | 2 | 0.023 | 0.002 |
| 30 | A309 | 3 | Resin 1 | 1 | Crosslinking agent 2 | 2 | 0.024 | 0.002 |
| 31 | A310 | 3 | Resin 1 | 1 | Crosslinking agent 3 | 2 | 0.022 | 0.005 |
| 32 | B303 | 3 | Resin 2 | 1 | Crosslinking agent 3 | 2 | 0.024 | 0.006 |
| 33 | B304 | 3 | Resin 2 | 1 | Crosslinking agent 1 | 2 | 0.025 | 0.007 |
| 34 | B308 | 3 | Resin 2 | 1 | Crosslinking agent 1 | 2 | 0.024 | 0.002 |
| 35 | C301 | 3 | Resin 2 | 1 | Crosslinking agent 1 | 2 | 0.021 | 0.006 |
| 36 | C305 | 3 | Resin 1 | 1 | Crosslinking agent 1 | 2 | 0.023 | 0.008 |
| 37 | C306 | 3 | Resin 1 | 1 | Crosslinking agent 1 | 2 | 0.022 | 0.002 |
| 38 | A501 | 3 | Resin 1 | 3 | — | — | 0.028 | 0.007 |
| 39 | A504 | 3 | Resin 1 | 1 | Crosslinking agent 1 | 2 | 0.028 | 0.008 |
| 40 | B503 | 3 | Resin 1 | 1 | Crosslinking agent 1 | 2 | 0.027 | 0.007 |
| 41 | C501 | 3 | Resin 1 | 3 | — | — | 0.028 | 0.007 |

TABLE 3

| | Compound | | Resin | | | | Macbeth density difference | |
|---|---|---|---|---|---|---|---|---|
| Comparative Example | Kind | Composition ratio | Kind | Composition ratio | Crosslinking agent Kind | Composition ratio | Initial density | Change |
| 1 | Compound (6) | 3 | Resin 1 | 3 | — | — | 0.037 | 0.081 |
| | Compound (7) | 3 | Resin 1 | 3 | — | — | 0.042 | 0.083 |
| 3 | Compound (8) | 3 | Resin 1 | 3 | — | — | 0.047 | 0.085 |
| 4 | Compound (9) | 3 | Resin 1 | 3 | — | — | 0.035 | 0.080 |
| 5 | Compound (10) | 3 | Resin 1 | 3 | — | — | 0.049 | 0.081 |
| 6 | Compound (11) | 3 | Resin 1 | 1 | Crosslinking agent 1 | 2 | 0.052 | 0.087 |
| 7 | Compound (12) | 3 | Resin 1 | 1 | Crosslinking agent 1 | 2 | 0.057 | 0.089 |
| 8 | Compound (13) | 3 | Resin 1 | 1 | Crosslinking agent 1 | 2 | 0.062 | 0.091 |
| 9 | Compound (14) | 3 | Resin 1 | 1 | Crosslinking agent 1 | 3 | 0.043 | 0.055 |

In Table 2 and Table 3, the crosslinking agent 1 is a blocked isocyanate compound (trade name: SBN-70D, manufactured by Asahi Kasei Chemicals Corporation (solid content: 70%)). The crosslinking agent 2 is an isocyanate-based crosslinking agent (trade name: DESMODUR BL3575, manufactured by Sumika Bayer Urethane Co., Ltd. (solid content: 60%)). The crosslinking agent 3 is a butylated melamine-based crosslinking agent (trade name: SUPER BECKAMINE J821-60, manufactured by DIC Corporation (solid content: 60%)). The crosslinking agent 4 is a butylated urea-based crosslinking agent (trade name: BECKAMINE P138, manufactured by DIC Corporation (solid content: 60%)).

In Table 2 and Table 3, the resin 1 (resin having a polymerizable functional group) is a polyvinyl acetal resin having a number of moles of hydroxy groups per g of 3.3 mmol and a molecular weight of $1\times10^5$. The resin 2 is a polyvinyl acetal resin having a number of moles of hydroxy groups per g of 3.3 mmol and a molecular weight of $2\times10^4$. The resin 3 is a polyvinyl acetal resin having a number of moles of hydroxy groups per g of 2.5 mmol and a molecular weight of $3.4\times10^5$.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-128104, filed Jun. 25, 2015, which is hereby incorporated by reference herein in its entirety.

What is claimed is:

1. An electrophotographic photosensitive member, comprising:

an electroconductive support;

an undercoat layer formed on the support; and a photosensitive layer formed on the undercoat layer, wherein the undercoat layer contains a compound represented by formula (1):

Formula (1)

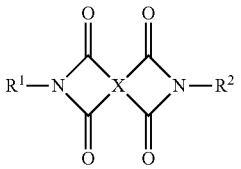

where $R^1$ represents a substituted or unsubstituted alkyl group having 7 to 20 carbon atoms in a main chain thereof, a group derived by substituting at least one $CH_2$ in a main chain of a substituted or unsubstituted alkyl group having 7 to 20 carbon atoms in the main chain with an oxygen atom, a group derived by substituting at least one $CH_2$ in a main chain of a substituted or unsubstituted alkyl group having 7 to 20 carbon atoms in the main chain with a sulfur atom, a group derived by substituting at least one $CH_2$ in a main chain of a substituted or unsubstituted alkyl group having 7 to 20 carbon atoms in the main chain with $NR^{17}$, a group derived by substituting at least one $CH_2$ in a main chain of a substituted or unsubstituted alkyl group having 7 to 20 carbon atoms in the main chain with $SiR^{18}R^{19}$, a group derived by substituting at least one carbon-carbon single bond in a main chain of a substituted or unsubstituted alkyl group having 7 to 20 carbon atoms in the main chain with a carbon-carbon double bond, a substituted or unsubstituted cycloalkyl group having 7 to 20 carbon atoms in a main chain thereof, or a substituted or unsubstituted aryl group, and $R^{17}$, $R^{18}$, and $R^{19}$ each independently represent a hydrogen atom, a substituted or unsubstituted alkyl group having 1 to 4 carbon atoms in a main chain thereof, or a substituted or unsubstituted aryl group;

$R^2$ represents a substituted or unsubstituted alkyl group having 7 to 20 carbon atoms in a main chain thereof, a group derived by substituting at least one $CH_2$ in a main chain of a substituted or unsubstituted alkyl group having 7 to 20 carbon atoms in the main chain with an oxygen atom, a group derived by substituting at least one $CH_2$ in a main chain of a substituted or unsubstituted alkyl group having 7 to 20 carbon atoms in the main chain with a sulfur atom, a group derived by substituting at least one $CH_2$ in a main chain of a substituted or unsubstituted alkyl group having 7 to 20 carbon atoms in the main chain with $NR^{20}$, a group derived by substituting at least one $CH_2$ in a main chain of a substituted or unsubstituted alkyl group having 7 to 20 carbon atoms in the main chain with $SiR^{21}R^{22}$, a group derived by substituting at least one carbon-carbon single bond in a main chain of a substituted or unsubstituted alkyl group having 7 to 20 carbon atoms in the main chain with a carbon-carbon double bond, or a substituted or unsubstituted cycloalkyl group having 7 to 20 carbon atoms in a main chain thereof, and $R^{20}$,$R^{21}$, and $R^{22}$ each independently represent a hydrogen atom, a substituted or unsubstituted alkyl group having 1 to 4 carbon atoms in a main chain thereof, or a substituted or unsubstituted aryl group;

a substituent of the alkyl group comprises an alkyl group having 1 to 6 carbon atoms, a benzyl group, or a phenyl group;

a substituent of each of the group derived by substituting at least one $CH_2$ in the main chain of the alkyl group with an oxygen atom, the group derived by substituting at least one $CH_2$ in the main chain of the alkyl group with a sulfur atom, the group derived by substituting at least one $CH_2$ in the main chain of the alkyl group with $NR^{17}$ or $NR^{20}$, the group derived by substituting at least one $CH_2$ in the main chain of the alkyl group with $SiR^{18}R^{19}$ or $SiR^{21}R^{22}$, the group derived by substituting at least one carbon-carbon single bond in the main chain of the alkyl group with a carbon-carbon double bond, and the cycloalkyl group includes an alkyl group having 1 to 6 carbon atoms, a benzyl group, or a phenyl group;

a substituent of the aryl group comprises a halogen atom, a cyano group, a nitro group, an alkyl group having 1 to 4 carbon atoms, an acyl group, or an alkoxy group; and X represents one structure selected from the group consisting of formula (X1), formula (X2), and formula (X3):

(X1)

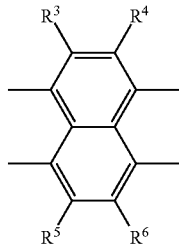

(X2)

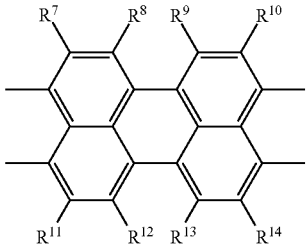

(X3)

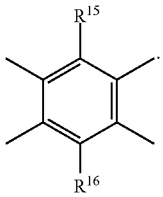

where $R^3$ to $R^{16}$ each independently represent a hydrogen atom, a halogen atom, a cyano group, a nitro group, a substituted or unsubstituted alkyl group having 1 to 4 carbon atoms in a main chain thereof, or a substituted or unsubstituted aryl group.

2. A process cartridge, comprising:

an electrophotographic photosensitive member; and at least one unit selected from the group consisting of a charging unit, a developing unit, a transferring unit, and a cleaning unit, the process cartridge integrally supporting the electrophotographic photosensitive member and the at least one unit, and being removably mounted onto an electrophotographic apparatus, the electrophotographic photosensitive member comprising:

an electroconductive support;

an undercoat layer formed on the support; and a photosensitive layer formed on the undercoat layer, wherein the undercoat layer contains a compound represented by formula (1):

(1)

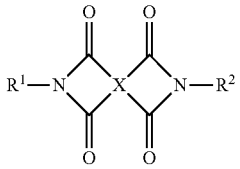

where $R^1$ represents a substituted or unsubstituted alkyl group having 7 to 20 carbon atoms in a main chain thereof, a group derived by substituting at least one $CH_2$ in a main chain of a substituted or unsubstituted alkyl group having 7 to 20 carbon atoms in the main chain with an oxygen atom, a group derived by substituting at least one $CH_2$ in a main chain of a substituted or unsubstituted alkyl group having 7 to 20 carbon atoms in the main chain with a sulfur atom, a group derived by substituting at least one $CH_2$ in a main chain of a substituted or unsubstituted alkyl group having 7 to 20 carbon atoms in the main chain with $NR^{17}$, a group derived by substituting at least one $CH_2$ in a main chain of a substituted or unsubstituted alkyl group having 7 to 20 carbon atoms in the main chain with $SiR^{18}R^{19}$, a group derived by substituting at least one carbon-carbon single bond in a main chain of a substituted or unsubstituted alkyl group having 7 to 20 carbon atoms in the main chain with a carbon-carbon double bond, a substituted or unsubstituted cycloalkyl group having 7 to 20 carbon atoms in a main chain thereof, or a substituted or unsubstituted aryl group, and $R^{17}$, $R^{18}$, and $R^{19}$ each independently represent a hydrogen atom, a substituted or unsubstituted alkyl group having 1 to 4 carbon atoms in a main chain thereof, or a substituted or unsubstituted aryl group;

$R^2$ represents a substituted or unsubstituted alkyl group having 7 to 20 carbon atoms in a main chain thereof, a group derived by substituting at least one $CH_2$ in a main chain of a substituted or unsubstituted alkyl group having 7 to 20 carbon atoms in the main chain with an oxygen atom, a group derived by substituting at least one $CH_2$ in a main chain of a substituted or unsubstituted alkyl group having 7 to 20 carbon atoms in the main chain with a sulfur atom, a group derived by substituting at least one $CH_2$ in a main chain of a substituted or unsubstituted alkyl group having 7 to 20 carbon atoms in the main chain with $NR^{20}$, a group derived by substituting at least one $CH_2$ in a main chain of a substituted or unsubstituted alkyl group having 7 to 20 carbon atoms in the main chain with $SiR^{21}R^{22}$, a group derived by substituting at least one carbon-carbon single bond in a main chain of a substituted or unsubstituted alkyl group having 7 to 20 carbon atoms in the main chain with a carbon-carbon double bond, or a substituted or unsubstituted cycloalkyl group having 7 to 20 carbon atoms in a main chain thereof, and $R^{20}$, $R^{21}$, and $R^{22}$ each independently represent a hydrogen atom, a substituted or unsubstituted alkyl group having 1 to 4 carbon atoms in a main chain thereof, or a substituted or unsubstituted aryl group;

a substituent of the alkyl group comprises an alkyl group having 1 to 6 carbon atoms, a benzyl group, or a phenyl group;

a substituent of each of the group derived by substituting at least one $CH_2$ in the main chain of the alkyl group with an oxygen atom, the group derived by substituting at least one $CH_2$ in the main chain of the alkyl group with a sulfur atom, the group derived by substituting at least one $CH_2$ in the main chain of the alkyl group with $NR^{17}$ or $NR^{20}$, the group derived by substituting at least one $CH_2$ in the main chain of the alkyl group with $SiR^{18}R^{19}$ or $SiR^{21}R^{22}$, the group derived by substituting at least one carbon-carbon single bond in the main chain of the alkyl group with a carbon-carbon double bond, and the cycloalkyl group includes an alkyl group having 1 to 6 carbon atoms, a benzyl group, or a phenyl group;

a substituent of the aryl group comprises a halogen atom, a cyano group, a nitro group, an alkyl group having 1 to 4 carbon atoms, an acyl group, or an alkoxy group; and X represents one structure selected from the group consisting of formula (X1), formula (X2), and formula (X3):

(X1)

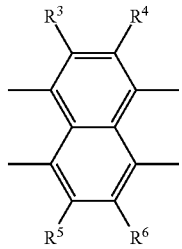

(X2)

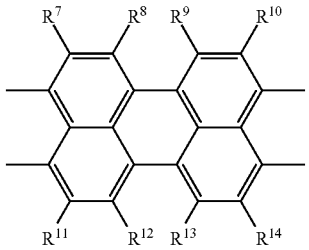

(X3)

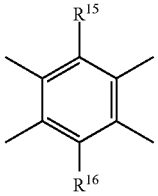

where $R^3$ to $R^{16}$ each independently represent a hydrogen atom, a halogen atom, a cyano group, a nitro group, a substituted or unsubstituted alkyl group having 1 to 4 carbon atoms in a main chain thereof, or a substituted or unsubstituted aryl group.

3. An electrophotographic apparatus, comprising:

an electrophotographic photosensitive member;

a charging unit;

an exposing unit;

a developing unit; and a transferring unit, the electrophotographic photosensitive member comprising:

an electroconductive support;

an undercoat layer formed on the support; and a photosensitive layer formed on the undercoat layer, wherein the undercoat layer contains a compound represented by formula (1):

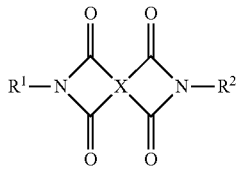

where $R^1$ represents a substituted or unsubstituted alkyl group having 7 to 20 carbon atoms in a main chain thereof, a group derived by substituting at least one $CH_2$ in a main chain of a substituted or unsubstituted alkyl group having 7 to 20 carbon atoms in the main chain with an oxygen atom, a group derived by substituting at least one $CH_2$ in a main chain of a substituted or unsubstituted alkyl group having 7 to 20 carbon atoms in the main chain with a sulfur atom, a group derived by substituting at least one $CH_2$ in a main chain of a substituted or unsubstituted alkyl group having 7 to 20 carbon atoms in the main chain with $NR^{17}$, a group derived by substituting at least one $CH_2$ in a main chain of a substituted or unsubstituted alkyl group having 7 to 20 carbon atoms in the main chain with $SiR^{18}R^{19}$, a group derived by substituting at least one carbon-carbon single bond in a main chain of a substituted or unsubstituted alkyl group having 7 to 20 carbon atoms in the main chain with a carbon-carbon double bond, a substituted or unsubstituted cycloalkyl group having 7 to 20 carbon atoms in a main chain thereof, or a substituted or unsubstituted aryl group, and $R^{17}$, $R^{18}$, and $R^{19}$ each independently represent a hydrogen atom, a substituted or unsubstituted alkyl group having 1 to 4 carbon atoms in a main chain thereof, or a substituted or unsubstituted aryl group;

$R^2$ represents a substituted or unsubstituted alkyl group having 7 to 20 carbon atoms in a main chain thereof, a group derived by substituting at least one $CH_2$ in a main chain of a substituted or unsubstituted alkyl group having 7 to 20 carbon atoms in the main chain with an oxygen atom, a group derived by substituting at least one $CH_2$ in a main chain of a substituted or unsubstituted alkyl group having 7 to 20 carbon atoms in the main chain with a sulfur atom, a group derived by substituting at least one $CH_2$ in a main chain of a substituted or unsubstituted alkyl group having 7 to 20 carbon atoms in the main chain with $NR^{20}$, a group derived by substituting at least one $CH_2$ in a main chain of a substituted or unsubstituted alkyl group having 7 to 20 carbon atoms in the main chain with $SiR^{21}R^{22}$, a group derived by substituting at least one carbon-carbon single bond in a main chain of a substituted or unsubstituted alkyl group having 7 to 20 carbon atoms in the main chain with a carbon-carbon double bond, or a substituted or unsubstituted cycloalkyl group having 7 to 20 carbon atoms in a main chain thereof, and $R^{20}$, $R^{21}$, and $R^{22}$ each independently represent a hydrogen atom, a substituted or unsubstituted alkyl group having 1 to 4 carbon atoms in a main chain thereof, or a substituted or unsubstituted aryl group;

a substituent of the alkyl group comprises an alkyl group having 1 to 6 carbon atoms, a benzyl group, or a phenyl group;

a substituent of each of the group derived by substituting at least one $CH_2$ in the main chain of the alkyl group with an oxygen atom, the group derived by substituting at least one $CH_2$ in the main chain of the alkyl group with a sulfur atom, the group derived by substituting at least one $CH_2$ in the main chain of the alkyl group with $NR^{17}$ or $NR^{20}$ , the group derived by substituting at least one $CH_2$ in the main chain of the alkyl group with $SiR^{18}R^{19}$ or $SiR^{21}R^{22}$, the group derived by substituting at least one carbon-carbon single bond in the main chain of the alkyl group with a carbon-carbon double bond, and the cycloalkyl group includes an alkyl group having 1 to 6 carbon atoms, a benzyl group, or a phenyl group;

a substituent of the aryl group comprises a halogen atom, a cyano group, a nitro group, an alkyl group having 1 to 4 carbon atoms, an acyl group, or an alkoxy group; and X represents one structure selected from the group consisting of formula (X1), formula (X2), and formula (X3):

(X1)

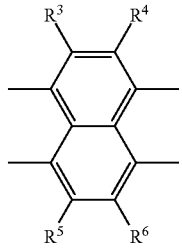

(X2)

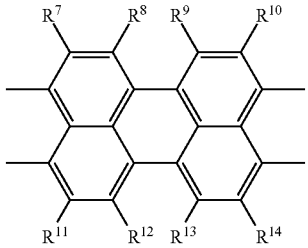

(X3)

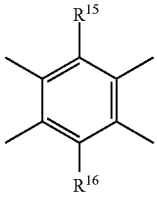

where $R^3$ to $R^{16}$ each independently represent a hydrogen atom, a halogen atom, a cyano group, a nitro group, a substituted or unsubstituted alkyl group having 1 to 4 carbon atoms in a main chain thereof, or a substituted or unsubstituted aryl group.

* * * * *